US007124718B2

(12) United States Patent
Artola

(10) Patent No.: US 7,124,718 B2
(45) **Date of Patent: *Oct. 24, 2006**

(54) MULTI-CHAMBER INTERNAL COMBUSTION ENGINE

(76) Inventor: Jorge Artola, 230 Alta Loma Dr., South San Francisco, CA (US) 94080

( * ) Notice: Subject to any disclaimer, the term of this patent is extended or adjusted under 35 U.S.C. 154(b) by 0 days.

This patent is subject to a terminal disclaimer.

(21) Appl. No.: 11/042,601

(22) Filed: Jan. 24, 2005

(65) Prior Publication Data

US 2005/0126519 A1 Jun. 16, 2005

(51) Int. Cl.
*F02B 33/10* (2006.01)

(52) U.S. Cl. ..... 123/71 R

(58) Field of Classification Search ..... 123/57.1, 123/71 R, 45 A, 47 A, 45 R
See application file for complete search history.

(56) References Cited

U.S. PATENT DOCUMENTS

| | | | | |
|---|---|---|---|---|
| 2,132,595 | A | 10/1938 | Bancroft | |
| 2,807,249 | A | 9/1957 | Peras | |
| 3,886,805 | A | 6/1975 | Koderman | |
| 4,366,784 | A * | 1/1983 | Paul | 123/45 A |
| 4,485,768 | A | 12/1984 | Heniges | |
| 4,887,558 | A * | 12/1989 | Bernard | 123/57.1 |
| 5,158,046 | A | 10/1992 | Rucker | |
| 5,233,949 | A | 8/1993 | Rucker | |
| 5,884,590 | A | 3/1999 | Minculescu | |
| 6,024,067 | A | 2/2000 | Takachi et al. | |
| 6,209,495 | B1 | 4/2001 | Warren | |
| 6,742,482 | B1 * | 6/2004 | Artola | 123/71 R |

FOREIGN PATENT DOCUMENTS

WO WO 2004/067930 8/2004

* cited by examiner

*Primary Examiner*—Stephen K. Cronin
*Assistant Examiner*—Hyder Ali
(74) *Attorney, Agent, or Firm*—Weide & Miller, Ltd.

(57) ABSTRACT

An internal combustion engine includes a piston dividing a cylinder into first and second variable volume chambers on either side thereof. One chamber admits and compresses air which is delivered to another chamber for combustion. The other chamber admits combustion gasses, causing the piston to translate in the cylinder. In one embodiment, combustion of fuel occurs in a combustion chamber separate from the first and second variable volume chambers. In one embodiment, the translation of the piston effects movement of a connecting rod connected to an output shaft. In another embodiment, the piston is mounted on an output shaft and translation of the piston causes the piston to rotate, thus effecting rotation of the output shaft.

14 Claims, 27 Drawing Sheets

0°
45°
90°
135°
180°
225°
270°
315°
x
y
22
28
68
72
84
86

MULTI-CHAMBER INTERNAL COMBUSTION ENGINE

RELATED APPLICATION DATA

This application claims priority to International Patent Application No. PCT/US2003/002175, filed Jan. 23, 2003, which claims priority to U.S. patent application Ser. No. 09/935,447, filed Aug. 22, 2001.

FIELD OF THE INVENTION

The present invention relates to internal combustion engines, and more particularly to such an engine including a double-acting piston and a precombustion/combustion chamber.

BACKGROUND OF THE INVENTION

In accordance with the laws of thermodynamics, it is desirable to provide an engine which maximizes pressure and temperature during combustion, as such results in the most efficient conversion of energy. In addition, in accordance with the laws of physics, the power to weight ratio of an engine increases as the speed of engine operation increases.

Unfortunately, a variety of secondary effects make difficult the achievement of an engine which achieves these objectives. As engine speed increases, so do the inertial forces and the stresses placed upon moving parts in the engine. At high speeds, the failure rate of these parts increases. Increasing the size of these parts to increase their strength has limited benefits, as such further increases the inertial forces and the total weight of the engine.

In some instances, current engine designs also do not permit ready solutions to these problems. For a number of reasons, traditional piston rods are much longer than the distance of the entire piston stroke. One advantage arising from a longer piston rods is such permits a longer piston stroke, and thus a higher compression ratio. The longer piston rod also provides greater clearance between the piston and crankshaft at bottom dead center. On the other hand, the longer piston rod is subject to high inertial forces.

A problem with raising engine temperatures and pressures is that the life of parts subjected to these high heat and pressures in the engine are reduced. In order to reduced the detrimental effects of the high heat, today's engines employ cooling systems. The cooling systems, however, serve to reduce the efficiency of the system.

Another problem with an engine operating at high speed is that the time for combustion is very short. To accommodate combustion time, combustion may be initiated before the piston is at top dead center. Combustion forces generated as the piston moves upwardly to top dead center act against the direction of the piston, contributing to a lower energy level of the engine. On the other hand, if combustion is not initiated until the piston is at top dead center, then total optimum combustion time is very short. As a result, the generated combustion force is limited, and so is the power output of the engine in relation to provided fuel.

Another disadvantage of a short combustion time is that certain less combustible alternative fuels are not usable in these engines. Simply, the combustion time is so short that slower combusting fuels do not sufficiently combust to generate efficient engine power. A problem with existing engines is that the optimal combustion time is so short, that it is detrimental to raise the speed of the engine because optimal combustion time is further shortened. This problem thus prevents achievement of an engine with otherwise higher efficiency by operation at higher speeds.

Two-cycle internal combustion engines have an advantage over four-cycle internal combustion engines in that an entire piston cycle is not lost without producing force. On the other hand, combustion effects are reduced due to incomplete scavenging: not all of the exhaust gasses are exhausted before combustion initiates, and insufficient incoming air is provided for complete combustion of the fuel.

One detrimental side effect of this incomplete combustion of fuel is the exhausting of unburned fuel and undesirable gasses. Due to the emission problems associated with two-cycle engines, in some instances U.S. laws prevent the operation of two-cycle engines.

Another problem with existing engines is that they are not suited to miniaturization and for use not only as prime movers, but as compressors and pumps. In particular, the current design of internal combustion engines, including by reason of having so many moving parts, is not suited to such adaptation.

An engine which is capable of exploiting the advantages of high pressures of combustion, high temperatures of combustion, and high engine speed is desired, as is an engine having minimal moving parts, such as one having no crankshaft or connecting rods, which is thus suited for miniaturization.

SUMMARY OF THE INVENTION

An improved internal combustion engine is disclosed. In one embodiment, the engine is a two-cycle engine with improved performance characteristics.

One aspect of the invention is an engine including a piston dividing a cylinder into first and second variable volume chambers on either side thereof. One chamber admits and compresses air which is delivered to a combustion chamber for combustion of fuel. The other chamber admits combustion gasses resulting from fuel combustion, causing the piston to translate in the cylinder, and expels exhaust gases in its return motion.

In one embodiment, the translation of the piston effects movement of a connecting rod connected to an output shaft. In another embodiment, the piston is mounted on an output shaft and translation of the piston causes the piston to rotate, thus effecting rotation of the output shaft.

In one embodiment, the engine is an internal combustion engine including an engine block. Preferably, at least two cylinder heads are mounted to the block. A piston is movably mounted in a cylinder bore defined by each cylinder head. The cylinder bore is generally closed at its top and bottom, whereby the piston divides the bore into a first variable volume intake chamber and a second variable volume combustion chamber. The cylinder head further defines a combustion chamber, the combustion chamber selectively in communication with the first variable volume intake chamber and the second variable volume combustion chamber.

At least one intake port is provided for permitting air to be drawn into the variable volume intake chamber. Air within the variable volume intake chamber is compressed when the piston in the cylinder bore moves downwardly.

At least one passage is provided for selectively permitting the compressed charge of air to flow into the combustion chamber. Once in the combustion chamber, the compressed air charge is heated, raising it to yet a higher pressure. A fuel delivery element is adapted to deliver fuel into the compressed air. A passage is provided permitting the fuel and air charge to flow from the combustion chamber to the variable volume expansion/combustion chamber.

At least one valve is provided for selectively opening and closing the passage(s) between the variable volume intake chamber and the combustion chamber, and the combustion chamber and variable volume expansion/combustion chamber.

Ignition of the fuel and air mixture in the combustion chamber and/or the first variable volume chamber and resulting expansion of gasses in that chamber causes the piston to move downwardly in the cylinder bore. The piston is connected to a crankshaft which is mounted to the engine block.

In one embodiment, the block includes a first block gear and a second block gear. The crankshaft has a first end and a second end and at least one, and preferably two, piston mounting portions located between its ends. Each piston mounting portion is positioned along a first axis offset from a second axis through the first and second ends of the crankshaft. A first crankshaft gear is located at the first end of the crankshaft, the first crankshaft gear engaging the first block gear. A second crankshaft gear is located at the second end of the crankshaft, the second crankshaft gear engaging the second block gear. Movement of the piston causes the crankshaft to rotate about the second axis and the second axis to move in a generally circular pathway.

In one embodiment, the ends of the piston are supported by eccentric bearings. The bearings permit rotation and translation (i.e. movement of the rotational axis of the crankshaft) of the crankshaft.

In one embodiment of the invention, the block has four sides positioned between its ends. A cylinder head is coupled to each of the sides, and a piston is movably mounted in the cylinder bore defined by each head. The crankshaft includes a first piston mounting portion and a second piston mounting portion. A first pair of pistons mounted at opposing sides of the block are connected to one another about the first piston mounting portion. A second pair of pistons mounted at opposing sides of the block are connected to one another about the second piston mounting portion.

In one embodiment, the intake port includes an intake valve adapted to selectively open and close the intake port. A single valve is located in the combustion chamber. The valve includes a first seal and a second seal. The first seal is adapted to selectively open and close the port or passage between the variable volume intake chamber and the combustion chamber. The second seal is adapted to selectively open and close the port or passage between the combustion chamber and the variable volume expansion/combustion chamber.

In one embodiment, the valve located in the combustion chamber is driven by a rocker arm. The rocker arm is, in turn, driven by an end of a follower. An opposing end of the follower is driven by a cam which is rotated by the crankshaft.

Another aspect of the invention is a lubricating and cooling system for a piston of an internal combustion engine, the piston having a head and a rod. A first end of the rod is coupled to the head and a second end of the rod is located opposite the first end thereof. A passage extends through the rod from the first end to the second end. An inlet leads from an exterior of the second end to the passage. At least one delivery passage is located in the head and extends from the passage in the head and returns to the passage in the rod. An outlet extends from the passage in rod.

At least one partition divides the passage through the rod into an inlet passage leading from the inlet to the delivery passage and an outlet passage leading from the delivery passage to the outlet. At least one lubrication directing element is located in the inlet passage and outlet passage, the at least one lubrication directing element generally inhibiting the flow of lubricant from the delivery passage to the inlet and from the outlet to the delivery passage.

Upward and downward movement of the piston during engine operation generates a pumping effect. Lubricant is drawn into the inlet and delivered to the head. The lubricant may be delivered through weeps to rings mounted on the exterior of the piston head. Excess lubricant is delivered back to the outlet.

In another embodiment of the invention, the engine includes a piston dividing a cylinder into first and second variable volume chambers. The engine also includes a combustion chamber, the combustion chamber having an inlet in communication with the first variable volume chamber, and an outlet, the outlet in communication with the second variable volume chamber. The engine includes an air intake, the intake leading to the first variable volume chamber and the engine having an exhaust, the exhaust in communication with the second variable volume chamber. So configured, air is drawn through the intake and delivered to the first variable volume chamber where it is compressed and then delivered to the combustion chamber. The compressed air is used to combusted added fuel, and the combustion gasses are then delivered from the combustion chamber to the second variable volume chamber, thus effecting movement of the piston, those combustion gasses expelled from the second variable volume chamber to the exhaust.

In one embodiment, at least one valve controls the flow of air from the intake to the first variable volume chamber, and from that chamber to the combustion chamber. Similarly, at least one valve controls the flow of air from the combustion chamber to the second variable volume chamber and from that chamber to the exhaust.

In one embodiment, the piston is mounted on an output shaft which extends through the cylinder. The piston is configured to translate or move along the output shaft, and at the same time rotate within the cylinder. The piston is mounted to the output shaft in a manner that rotation of the piston effects rotation of the output shaft.

In one embodiment, at least one slot is formed in the outside of the piston. At least one cam element engages the slot. Preferably, the slot is curvilinear and most preferably, sinusoidal in path. In this manner, translation of the piston causes the piston to rotate because of the inter-engagement of the cam element with the slot.

At least one slot is formed on the inner surface of the piston. A cam element extends from the output shaft and engages the slot. Preferably, the slot extends parallel to the cam element, permitting the piston to move parallel to the shaft along the shaft, but causing the output shaft to rotate as the piston rotates. The shape of the slots may be varied to control the operating characteristics of the engine. For example, the slots may be configured to extend the power/compression stroke of the engine and reduce the admission/exhaust stroke of the engine.

Another embodiment of the invention is a lubrication and cooling system for such an engine. In one embodiment, lubricating oil is directed through a passage which extends longitudinally through the output shaft. The oil also passes through connecting passages which provide oil to the piston and other internal components of the engine.

Various multi-piston engines are described. In one embodiment of the invention, pistons are mounted to individual main shafts, and those main shafts are connected. In another embodiment, two or more pistons are mounted to a common main shaft. The pistons may be located in a common cylinder.

An additional aspect of the invention is an accumulator. The accumulator is a safety features design to absorb any harmful excessive peak pressure in the combustion chamber and release is gradually to the cylinder later.

Further objects, features, and advantages of the present invention over the prior art will become apparent from the detailed description of the drawings which follows, when considered with the attached figures.

DETAILED DESCRIPTION OF THE INVENTION

Figure 2:
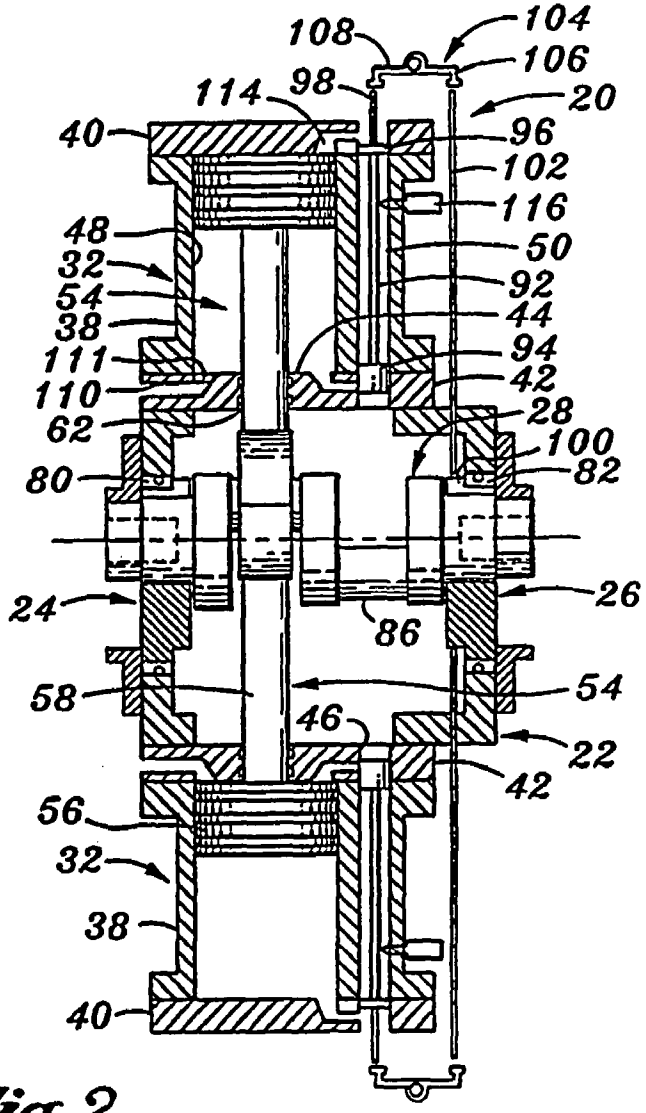
FIG. 2 is a cross-sectional view of the engine illustrated in FIG. 1 taken in the plane 2—2.

The invention is an internal combustion engine. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the present invention comprises an improved internal combustion engine. In a preferred embodiment, the engine operates on a two-cycle principal. In accordance with the invention, such an engine is provided with a two-way acting piston and a separate combustion chamber. Other aspects of the invention comprise an improved lubricating system for moving parts, an output shaft mounting and drive arrangement, and a valving configuration. It will be appreciated that the invention may extend to one or more of the features of the engine used alone or in combination with one another, and to such features as used in other than a two-cycle internal combustion engine, such as in four-cycle and diesel engines.

One embodiment of an internal combustion engine 20 in accordance with the invention will be described with reference to FIGS. 1–3. The engine 20 includes a block 22. The block 22 is also illustrated in more detail in FIG. 3. The block 22 preferably comprises a housing defining one or more hollow interior areas. The block 22 has a first end 24 and a second end 26 which support a crankshaft 28, which crankshaft 28 is described in detail below. The crankshaft 28 extends through the generally hollow interior of the block 22.

The block 22 generally has four sides 30*a,b,c,d* between its ends 24,26. Preferably, opposing pairs of sides are positioned in parallel, spaced apart planes, while adjacent sides adjoin at right angles. In this arrangement, the sides 30*a,b,c,d* define a generally cube-shaped block.

Each side 30*a,b,c,d* defines a mounting area for a head 32. Referring to FIG. 3, in one embodiment, each side 30*a,b,c,d* includes a main piston opening 34 and a valve opening 36. Preferably, these openings 34,36 are in communication with the hollow interior area of the block 22 housing the crankshaft 28.

Figure 1:
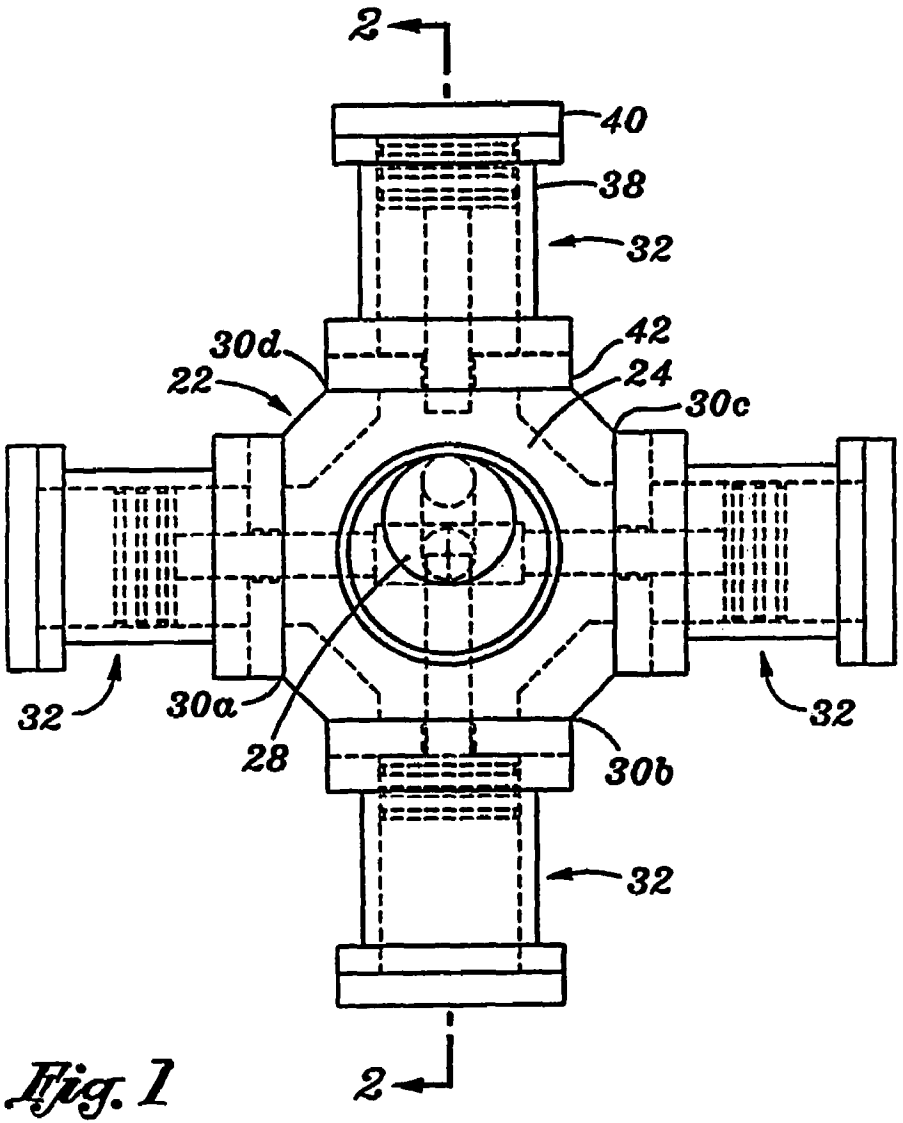
FIG. 1 is a plan view of an exterior of an embodiment of an engine in accordance with the present invention.
Figure 3:
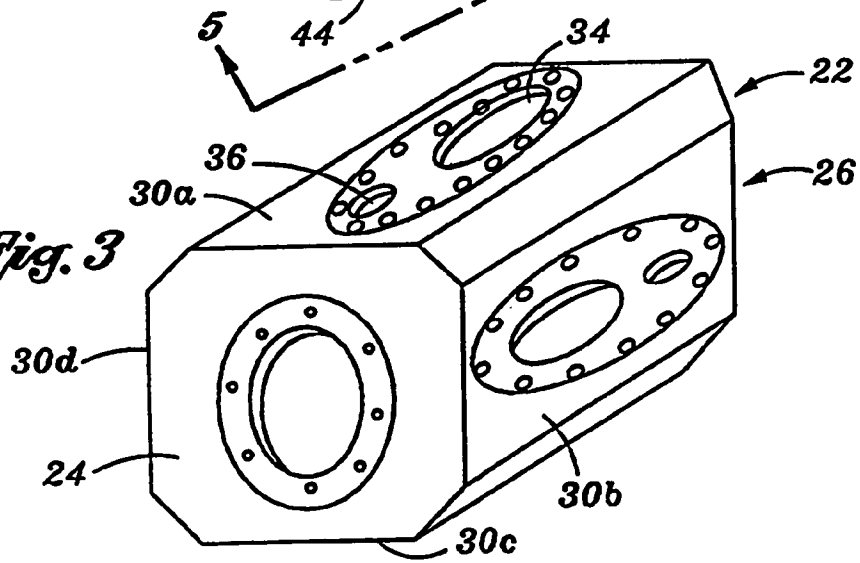
FIG. 3 is a perspective view of an engine block in accordance with an embodiment of the invention.

Referring to FIGS. 1 and 2, ahead 32 is connected to each side 30*a,b,c,d* of the block 22. Each head 32 may be connected to the block 22 in a variety of manners, such as with nuts and bolts. In one embodiment, the heads 32 may be formed with the block 22 in whole or in part.

Figure 4:
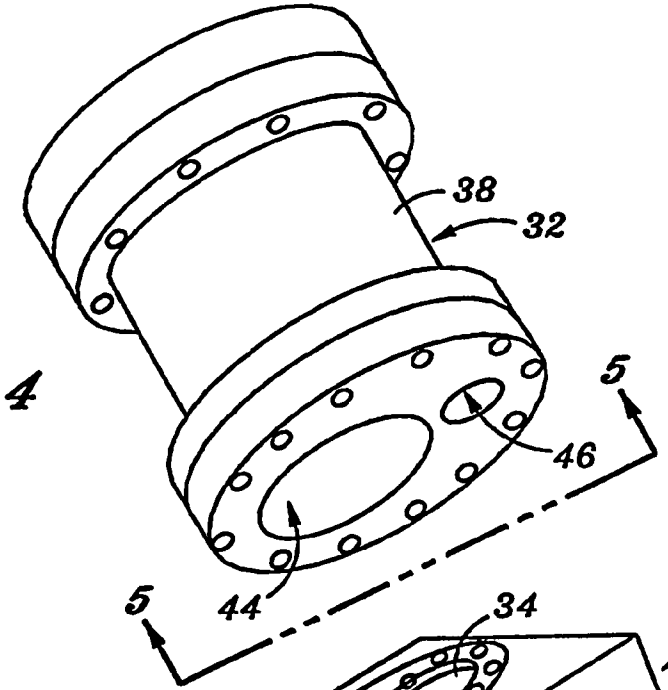
FIG. 4 is a perspective view of a cylinder head in accordance with an embodiment of the invention.

FIG. 4 illustrates the head 32 in perspective view. In a preferred embodiment, and referring to FIG. 2, each head 32 includes a body 38 and a cap 40. A bottom plate 42 is located at a first end of the body 38 of the head 32. The cap 40 is located at the opposing second end of the body 38 of the head 32. Preferably, when the head 32 is mounted to the block 22, the bottom plate 42 is positioned against the exterior of the side of the block 22. In one embodiment, the bottom plate 42 is formed integrally with the remainder of the body 38 of the head 32. Alternatively, the bottom plate 42 may be an independent element which is connected to the body 38 of the head 32.

Figure 12:
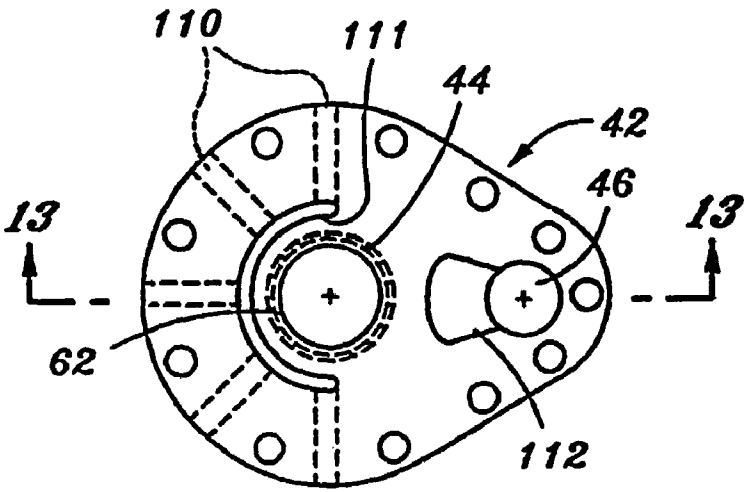
FIG. 12 is a top view of a bottom plate for the cylinder head illustrated in FIG. 4.

As illustrated in FIG. 12, the bottom plate 42 preferably includes a piston opening 44 and a valve opening 46. The size and orientation of these openings 44,46 is preferably similar to that of the openings 34,36 in the side of the block 22, whereby the openings in the block 22 and head 32 align when the head 32 is mounted to the block 22.

Figure 5:
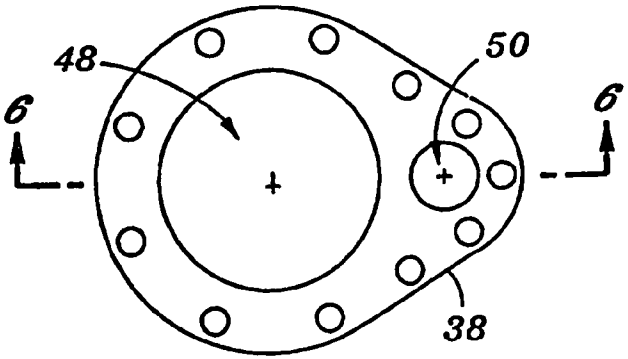
FIG. 5 is a bottom plan view of the cylinder head illustrated in FIG. 4.
Figure 6:
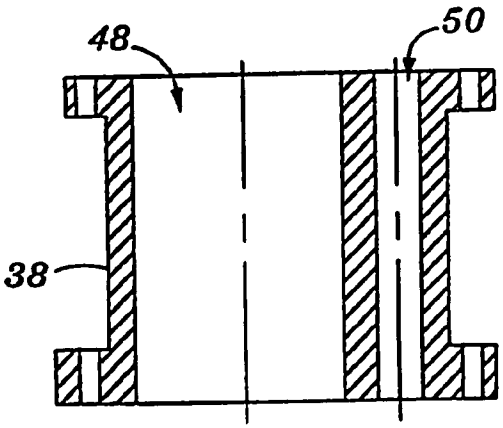
FIG. 6 is a cross-sectional view of the cylinder head illustrated in FIG. 5 taken along line 6—6 therein.

Referring to FIGS. 4–6, the body 38 of the head 32 defines a cylinder bore 48. The cylinder bore 48 is preferably an elongate cylindrical passage. The bore 48 may be of a variety of diameters. Referring to FIG. 2, when mounted, the piston opening 44 in the bottom plate 42 aligns with the cylinder bore 48 in the body 38. At the top end, the head cap 40 encloses the top of the cylinder bore 48. In a preferred embodiment, the head cap 40 is removable from the body 38 of the head 32, thus providing a means for access into the cylinder bore 48.

As illustrated in FIG. 6, the body 38 of the head 32 also defines a first combustion chamber 50. The first combustion chamber 50 is an elongate cylindrical bore extending from end-to-end through the body 38. In one embodiment, the diameter of the bore defining the first combustion chamber 50 is generally smaller than the diameter of the cylinder bore 48. Referring to FIG. 2, at the first end of the body 38, the valve opening 46 in the bottom plate 42 aligns with the first combustion chamber 50. At the top or second end of the body 38, the head cap 40 (see also FIG. 15) extends over but does not fully enclose the first combustion chamber 50. Instead, a small bore 52 is provided in the cap 40 in alignment with the bore defining the first combustion chamber for passage there through of a rod of a valve, as described in more detail below. The first combustion chamber 50 may be referred to as a precombustion chamber since, as detailed below, combustion may be initiated in the first chamber 50 and then continue in a second chamber.

Figures 7, 8:
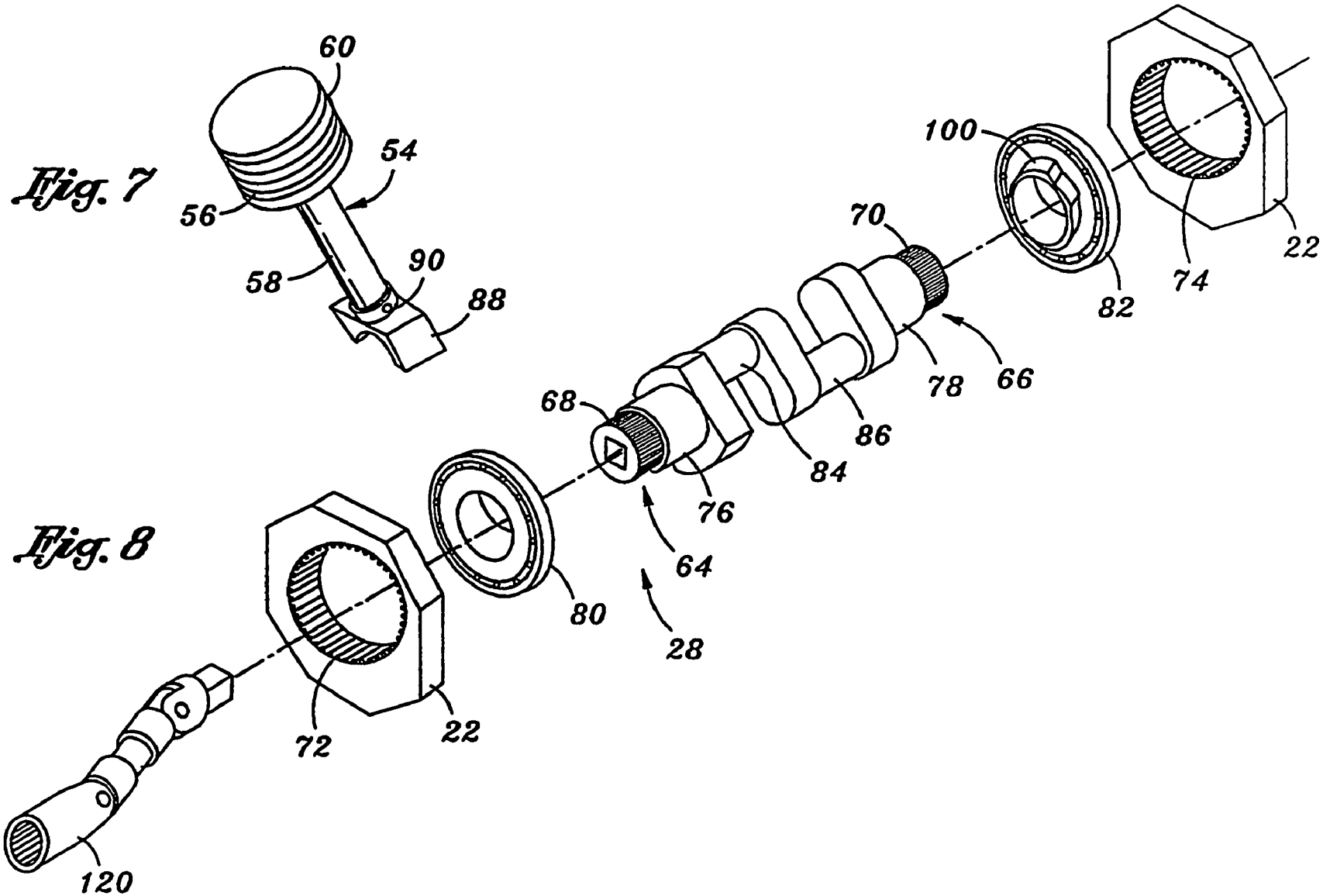
FIG. 7 is a perspective view of an embodiment of a piston in accordance with the invention.
FIG. 8 is a partial crankshaft assembly of the present invention illustrated in an exploded view.

A piston 54 is mounted in each cylinder bore 48 between the bottom plate 42 and the head cap 40. As best illustrated in FIG. 7, the piston 54 includes a head 56 and a rod 58 extending from the head 56. Preferably, the head 56 is a cylindrical body having a diameter slightly less than the diameter of the cylinder bore 48, and a height less than the length of the cylinder bore 48. The rod 58 is preferably a cylindrical member extending from the piston head 56 through the piston opening 44 in the bottom plate 42 to the crankshaft 28.

In one embodiment, one or more rings 60 are mounted on the exterior of the piston head 56. The rings 60 may include compression and oil rings, as are known in the art for sealing the piston head in the chamber, preventing gasses and fluids from moving from one side of the piston head to the other in the cylinder bore 48.

Referring to FIG. 2, a seal 62 is preferably provided for sealing the space between the piston rod 58 and the bottom plate 42 at the piston opening 44. The seal 62 may comprise a plurality of ring elements.

Still referring to FIG. 2, so mounted in its respective head 32, each piston 54 defines two variable volume chambers. A first variable volume chamber is located between the piston head 56 and the head cap 40. A second variable volume chamber is located between the piston head 56 and the bottom plate 42. As will be appreciated, as the piston 54 moves within the cylinder bore 48, the volumes of these chambers increase and decrease in proportion to one another. As will be appreciated later, the first chamber may be referred to as a variable volume combustion, expansion and/or exhaust chamber, while the second as a variable volume intake and/or compression chamber, owing to their functions.

As described in more detail below, combustion forces move the pistons 54 up and down within the cylinder bores 48. The movement of the pistons 54 is utilized to rotate the crankshaft 28.

Figure 9:
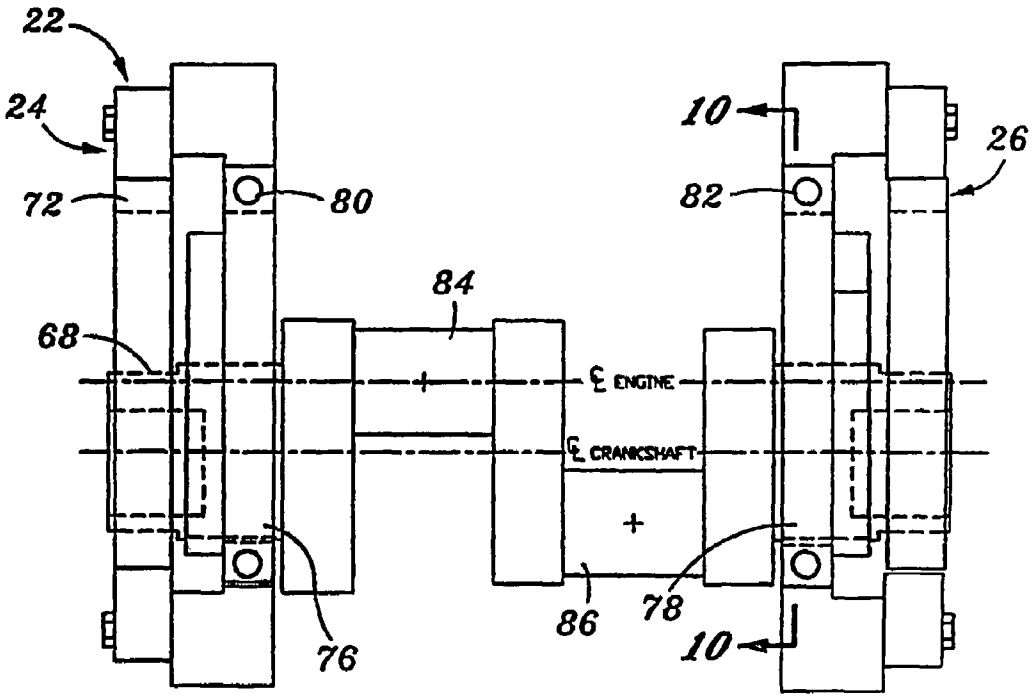
FIG. 9 is a side view of the crankshaft and a supporting assembly in accordance with the invention.

The crankshaft 28 will be described with reference to FIGS. 2, 8 and 9. The crankshaft 28 includes a body which is similar in many respects to crankshafts which are well known in the art. The crankshaft 28 has a first end 64 and a second end 66. The first and second ends 66 of the crankshaft 28 are rotatably supported by the block 22.

A first gear 68 is located at the first end 64 of the crankshaft 28. In one embodiment, the first gear 68 is integrally formed with the remainder of the crankshaft 28, and comprises a plurality of teeth formed about the exterior of the first end 64 of the crankshaft. The first gear 68 is configured to engage a first block gear 72. Preferably, the first block gear 72 comprises a gear member having teeth facing inwardly in a closed circular configuration. In one embodiment, the first block gear 72 may comprise mating teeth formed in the block 22 at the crankshaft opening at the first end 24 of the block 22. In another embodiment, a gear body is mounted to the exterior of the block 22, the gear body having a passage there through defined by a circular inner wall or perimeter having the teeth formed thereon.

Preferably, the circumference of the first gear 68 of the crankshaft 28 is smaller than (as described below, preferably one-half the size of) the circumference of the first block gear 72. Rotation of the crankshaft 28 causes the first gear 68 to move in a circular motion about the first block gear 72.

In one embodiment, a second gear 70 is located at the second end 66 of the crankshaft 28. In one embodiment, the second gear 70 is integrally formed with the remainder of the crankshaft 28, and comprises a plurality of teeth formed about the exterior of the second end 66 of the crankshaft. The second gear 70 is configured to engage a second block gear 74. Preferably, the second block gear 74 comprises a gear member having teeth facing inwardly in a closed circular configuration. In one embodiment, the second block gear 74 may comprise mating teeth formed in the block 22 at the crankshaft opening at the second end 26 of the block 22. In another embodiment, a gear body is mounted to the exterior of the block 22, the gear body having a passage there through defined by a circular inner wall or perimeter having the teeth formed thereon.

Preferably, the circumference of the second gear 70 of the crankshaft 28 is smaller than (as described below, preferably one-half the size of) the circumference of the second block gear 74. Rotation of the crankshaft 28 causes the second gear 70 to move in a circular motion about the second block gear 74.

Figure 10:
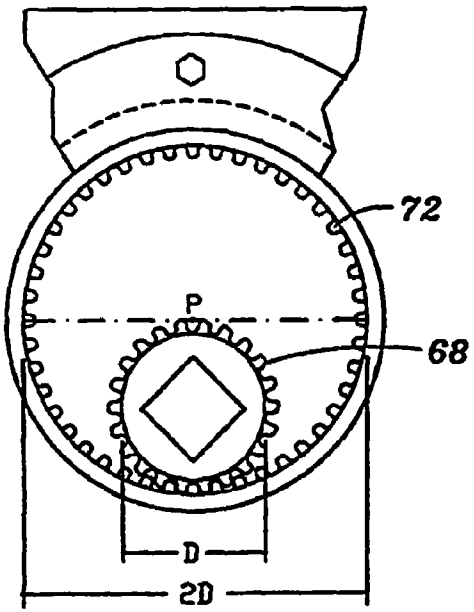
FIG. 10 illustrates the relationship between a crankshaft gear and supporting gear in accordance with an embodiment of the invention.

In a preferred embodiment, as best illustrated in FIG. 10, the diameter of the gear of the crankshaft 28 is D, while the diameter of the gear of the block 22 is 2D. In this arrangement, the diameter of the gear of the crankshaft is one-half of the size of the gear of the block.

The crankshaft 28 is preferably rotatably supported by the block 22, keeping the first and second crankshaft gears 68,70 in contact with the first and second block gears 72,74. In one embodiment, the crankshaft 28 includes a first journal portion 76 adjacent the first gear 68 and a second journal portion 78 adjacent the second gear 70. Each journal portion 76,78 comprises a smooth cylindrical portion of the crankshaft body.

A first eccentric bearing 80 engages the first journal portion 76 of the crankshaft 28. The first eccentric bearing 80 is supported by the block 22. In an embodiment where the first block gear 72 is mounted external to the first end 24 of the block 22, the eccentric bearing 80 may be supported by the wall of the block 22 forming the first end of the block.

Likewise, a second eccentric bearing 82 engages the second journal portion 78 of the crankshaft 28. The second eccentric bearing 82 is supported by the block 22. In an embodiment where the second block gear 74 is mounted external to the second end 26 of the block 22, the eccentric bearing 82 may be supported by the wall of the block 22 forming the second end of the block.

The crankshaft 28 includes a first piston set mount or mounting portion 84 and a second piston set mounting portion 86. Each mount or mounting portion 84,86 preferably comprises a generally smooth rod or cylinder-shaped portion of the crankshaft 28.

In a preferred embodiment, the mounts 84,86 are offset and do not have their centers along the same axis. In one embodiment, as illustrated in FIG. 9, the crankshaft 28 includes a crankshaft centerline CL which extends through the first and second ends 64,66 of the crankshaft 28. The axes through the center of each of the mounts 84,86 are offset from the crankshaft centerline CL and from one another. In one embodiment, the mounts 84,86 are aligned with a centerline of the engine CL at one or more times (when rotated into a particular position).

In one embodiment a first pair of opposing pistons 54 located nearest the first end 24 of the block 22 are connected to the first mount 84. A second pair of opposing pistons 54 located nearest the second end 26 of the block 22 are connected to the second mount 86. In one embodiment, each piston 54 is connected via a half-bearing 88 at the end of the piston rod 58 opposite the piston head 56. Referring to FIGS. 2 and 7, the half-bearing 88 is preferably designed to be connected to an opposing half-bearing associated with another piston. In this manner, opposing pistons 54 are mounted to one another about one of the piston mounting portions of the crankshaft 28. A pin 90 or other mounting may be used to connect the bearing 88 to the rod 58.

Referring again to FIG. 2, in a preferred embodiment of the invention, a valve 92 is associated with each first combustion chamber 50. In one embodiment, as illustrated in FIG. 11, the valve 92 is an elongate rod having a first end and a second end. A first seal 94 is located at the first end of the valve 92. The first seal 94 is preferably a circular disc located at the end of the rod forming the majority of the valve 92. The first seal 94 has an outer diameter slightly less than the inner diameter of the chamber 50.

A second seal 96 is located near the second end of the valve. The second seal 96 preferably also comprises a generally circular disk having a diameter slightly less than the inner diameter of the chamber 50.

A stem 98 is located at the second end of the valve 92. As illustrated, when positioned in the first or combustion chamber 50, the first seal 94 is located near the bottom plate 42 of the cylinder head 32. The second seal 96 is located near the head cap 40. The stem 98 extends through the bore 52 in the cap 40 to a point external to the cylinder head.

Figure 11A:
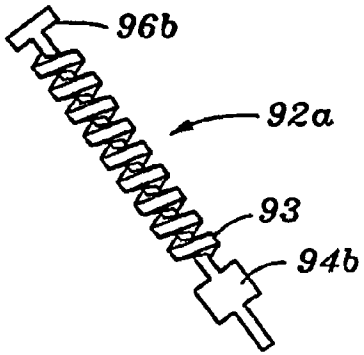
FIG. 11A is a perspective view of a valve rod with heat exchange element in accordance with another embodiment of the invention.
Figure 11:
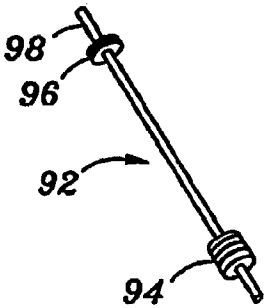
FIG. 11 is a perspective view of a valve rod in accordance with the invention.

FIG. 11A illustrates another embodiment of a valve 92*a*. In this embodiment, the valve 92*a* includes heat exchange element or member 93. In the embodiment illustrated, the heat exchange element 93 comprises a helical member position along a stem of the valve 92*a*. In general, the heat exchange element 93 is adapted to increase the surface area of the valve 92*a*, permitting a greater heat transfer rate. In on embodiment, the element 93 may be integrally formed with the stem or body portion of the valve 92*a*. Of course, other varieties of heat exchange elements may be utilized.

Referring to FIGS. 2 and 8, in a preferred embodiment, means are provided for moving the valve 92. In a preferred embodiment, the means includes a cam 100. In one embodiment, the cam 100 is mounted to the eccentric bearing 82 located at the second end of the crankshaft 28. The cam 100 has an outer surface which varies in distance from a rotational axis.

A follower 102 extends from the cam 100 upwardly from the cam 100 generally parallel to the cylinder head 32. A first end of the follower 102 engages the cam 100, such that rotation of the cam moves the follower up and down in accordance with the profile of the cam. Preferably, the profile of the cam 100 is appropriately configured to accomplish movement of the follower as described in detail below in conjunction with FIGS. 22A–F.

As illustrated in FIG. 2, a rocker 104 is located at the second end of the follower 102. The rocker 104 has a first arm 106 and a second arm 108 extending from either side of a pivot. The first arm 106 is arranged to engage a second end of the follower 102. The second arm 108 is arranged to engage the stem 98 of the valve 92. In one embodiment, a biasing means is provided for maintaining the follower 102 in engagement with the cam 100. The biasing means may comprise a spring associated with the rocker 104 causing the rocker to apply downward pressure upon the follower 104. As described in more detail below, upward movement of the follower 102 pushes the first arm 106 of the rocker upwardly, and thus the second arm 108 downwardly. Downward movement of the second arm 108 causes the valve 92 to be moved downwardly.

In one embodiment, the rocker 104 is mounted to the cylinder head 32. The rocker 104 and follower 102 may be located under a protective cover. Appropriate lubrication may be provided to these members. Of course, a follower 102 and rocker 104 are provided for each cylinder of the engine 20.

Biasing means may be provided for biasing the valve 92 upwardly, maintaining it in contact with the second arm 108 of the rocker 104. This biasing means may comprise a spring (not shown).

Passages are provided allowing air, fuel and mixtures of burned and unburned air and fuel to move in and out of the combustion chamber 50 and cylinder bore 48. In one embodiment, as illustrated in FIG. 2, an intake passage or port 110 is provided to the cylinder bore 48. Preferably, the intake passage 110 is provided in communication with a portion of the cylinder bore 48 below the piston head 56. As illustrated, the intake port 110 extends from an exterior of the head 32 through the bottom plate 42 to the bore 48. As described in more detail below, the intake port 110 permits fresh air to be drawn into the cylinder bore 48.

Figure 13:
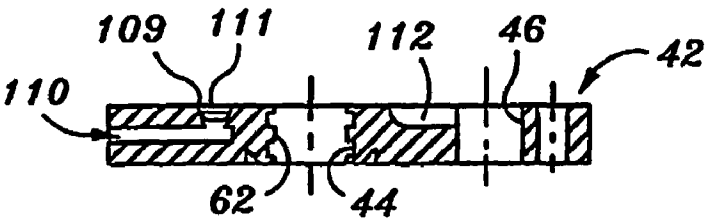
FIG. 13 is a cross-sectional view of the bottom plate illustrated in FIG. 12 taken along line 13—13 therein.

FIGS. 12 and 13 illustrate a preferred configuration of the bottom plate 42. As illustrated, the intake port 110 generally comprises a plurality of individual passages extending horizontally through the plate 42 to vertically extending inlet 109.

In one embodiment, a valve 111 is provided for selectively opening and closing the intake port 110. In a preferred embodiment, the valve 111 is a poppet type valve which is biased into a closed position. As described in more detail below, a condition of reduced pressure within the cylinder bore 48 causes the valve 111 to be moved upwardly as a result of the higher air pressure on the exterior side of the valve. As illustrated, the valve 111 is preferably "C" shaped and includes a head and a seating section, the seating section extending downwardly into the intake port 110 for use in guiding/aligning the valve 111.

A compression port 112 is provided between the cylinder bore 48 and the first chamber 50. In a preferred embodiment, the compression port 112 extends from a portion of the cylinder bore 48 below the piston head 56 to the first chamber 50. As illustrated, the compression port 112 is also provided in the bottom plate 42 of the cylinder head 32. A preferred arrangement of the bottom plate 42 including the compression port 112 is illustrated in FIGS. 12 and 13.

Figure 14:
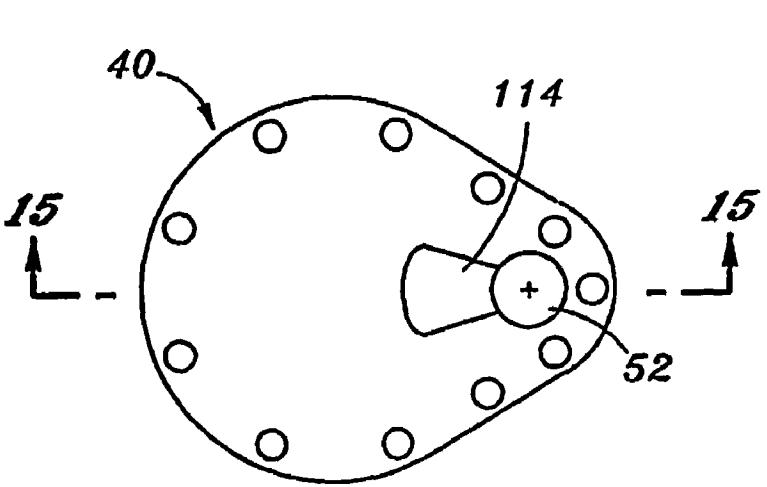
FIG. 14 is a bottom view of a cylinder cap for the cylinder head illustrated in FIG. 4.
Figure 15:
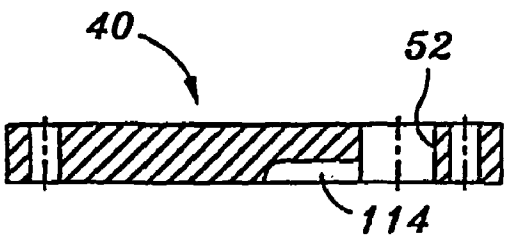
FIG. 15 is a cross-sectional view of the cylinder cap illustrated in FIG. 14 taken along line 15—15 therein.

As illustrated in FIG. 2, a bi-directional combustion and exhaust port 114 is provided as well. As illustrated, the bi-directional port 114 is provided in communication with a portion of the cylinder bore 48 above the piston head 56. At one or more times, the bi-directional port 114 is in communication with the first chamber 50. As illustrated, the bi-directional port 114 is provided in the cylinder cap 40. A preferred configuration of the cylinder cap 40 is illustrated in FIGS. 14 and 15.

As described in more detail below, the valve 92 is designed to cooperate with the compression port 112 and bi-directional port 114. The locations of these ports and the configuration of the valve 92 are designed to provide a specific effect. In particular, movement of the first seal 94 of the valve 92 is adapted to open and close the compression port 112 at its entrance to the first chamber 50. The movement of the second seal 96 of the valve 92 is adapted to open and close a pathway from the first chamber 50 to the bi-directional port 114 leading to the cylinder bore 48.

The engine 20 includes a fuel delivery system. Such systems are well known and thus are not described herein. In general, the engine 20 may use any of a variety of known fuel delivery systems. Preferably, the fuel delivery system includes a fuel supply, a pump or other means for moving the fuel from the supply and pressurizing the fuel, and a fuel injector 116 for injecting fuel under pressure. In a preferred embodiment, the fuel injector 116 is arranged to deliver fuel into the first chamber 50.

Appropriate controls are preferably provided for controlling the injector 116 associated with each cylinder 32. These controls are arranged to control the timing and duration of fuel delivery.

An ignition mechanism is provided for igniting a fuel and air mixture. In one embodiment, the ignition mechanism is associated with the combustion chamber 50. In one embodiment, the ignition mechanism includes a spark plug (not shown). The spark plug may have a tip positioned in the combustion chamber 50, such as by threading the plug into a passage through the cylinder body 38 or the cylinder cap 40. A control and power delivery system may be provided for delivering electrical energy to the spark plug at the appropriate time for the start of ignition.

In an alternate configuration, the engine may be configured so that the chamber 50 is simply a chamber in which the air/fuel mixture is heated and pressurized, with combustion actually initiated in the first variable volume chamber. In that case, the spark plug or other ignition mechanism is preferably configured to initiate combustion in the variable volume chamber.

As illustrated in FIG. 8, in one embodiment of the invention, an output shaft 120 is provided. The output shaft 120 is preferably coupled to the crankshaft 28 for transferring rotational energy of the crankshaft 28 to another element, such as a transmission. As illustrated, the output shaft 120 preferably comprises a shaft having a universal joint. In one embodiment, the output shaft 120 is keyed at one end for insertion into a correspondingly shaped aperture in the first end of the crankshaft 28 at the first end 24 of the engine 20. The opposing end of the output shaft 120 is formed as a female coupling to accept a driven member.

Figure 16:
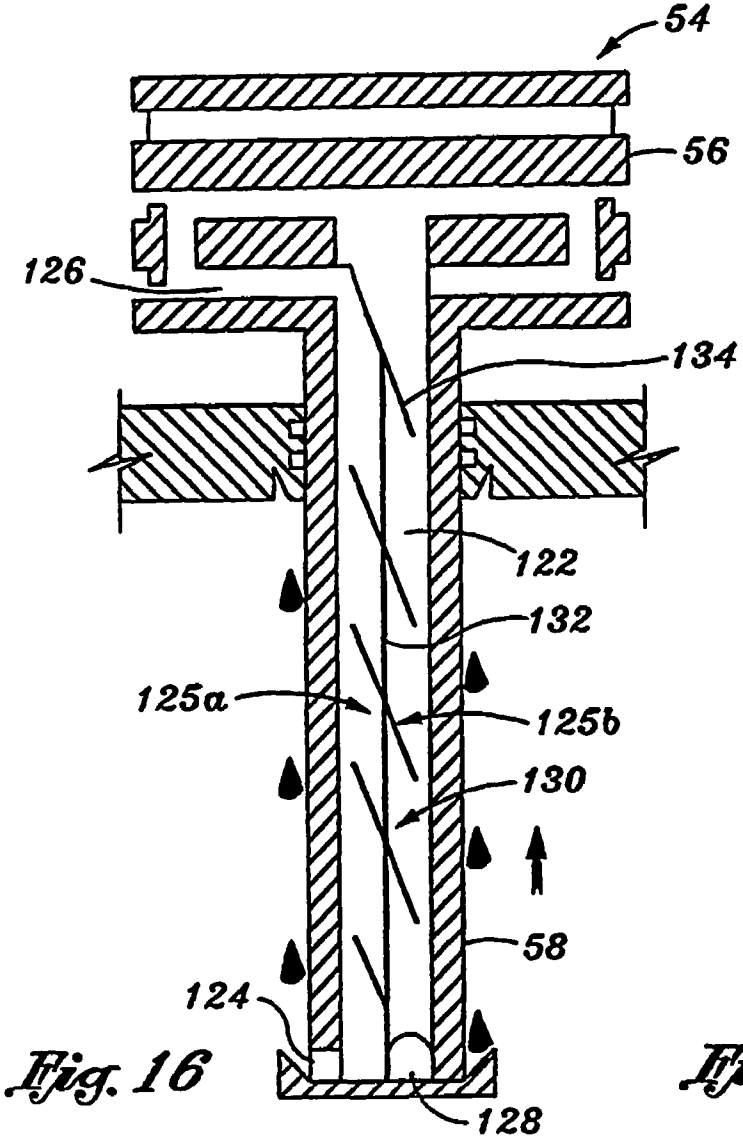
FIG. 16 is a cross-sectional view of a piston including a lubricating system in accordance with an embodiment of the invention.
Figure 17:
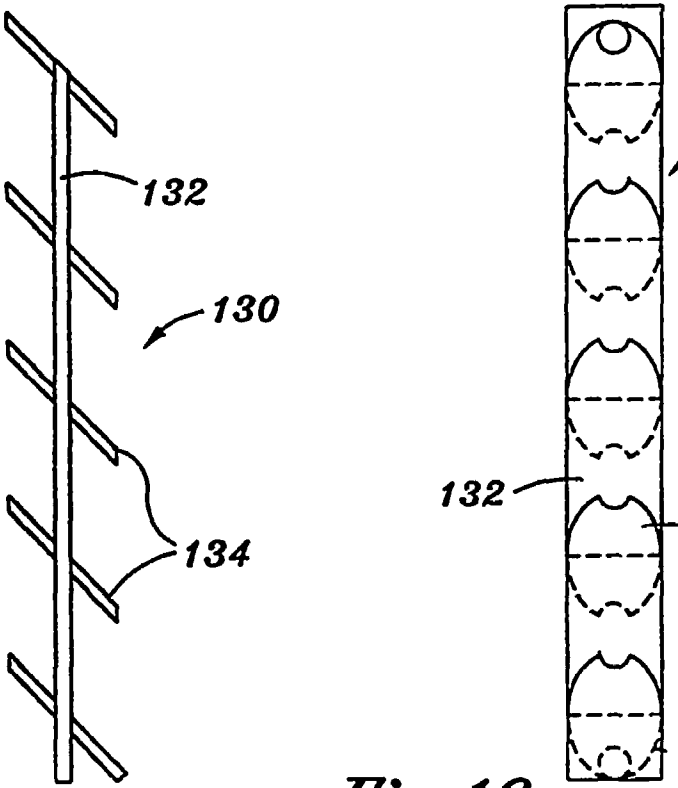
FIG. 17 is a side view of a lubricating system partition and diverter assembly for positioning in a piston as illustrated in FIG. 16.
Figure 19:
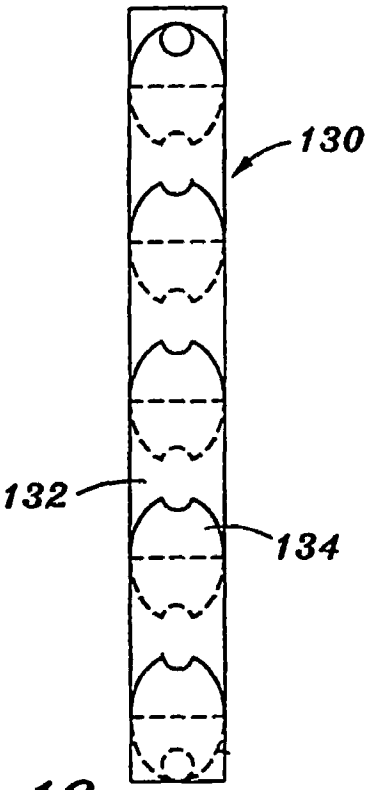
FIG. 19 is a front view of the assembly illustrated in FIG. 17.

Another aspect of the present invention is a lubricating system for one or more moving parts of an engine, such as the engine 20. In one embodiment, the invention is a lubricating system for each piston 54. In accordance with one embodiment of the invention, the rod 58 and at least a portion of each piston head 56 is hollow or has one or more passages there through. As illustrated in FIG. 16, a main passage 122 is provided through the rod 58. An inlet 124 is provided from the exterior of the rod 58 to the main passage 122. At least one delivery passage 126 extends from the main passage 122 in the rod 58 through the piston head 56 to an outer area thereof for delivering lubricant to the rings 60. The delivery passage 126 preferably extends back to the main passage 122. An outlet 128 is provided from the main passage 122 to the exterior of the rod 58.

In one embodiment, the inlet 124 is formed near a trough defined by an outwardly extending member, such as a portion of the half-bearing or mount 88.

In accordance with the invention, there is provided a means for moving lubricant through the main passage 122 to the delivery passage 126 to the rings 60. In a preferred embodiment, the means comprises a linear pump cell 130. The linear pump cell 130 is located in the main passage 122 of the rod 58. The linear pump cell 130 comprises a partition 132 and a plurality of flow directing elements 134. Preferably, the partition 132 divides the main passage 122 into two portions, a first passage 125*a* leading from the inlet 124 to the delivery passage 126, and a second passage 125*b* leading from the delivery passage 126 to the outlet 128. As best illustrated in FIGS. 16–19, the flow directing elements 134 comprise generally flat, elliptically shaped members. The elements 134 are mounted to the partition 132 at an angle with respect to horizontal, and preferably such that they angle upwardly in the portion of the main passage 122 leading from the inlet 124 and downwardly in the portion of the main passage 122 leading to the outlet 128.

Figure 18:
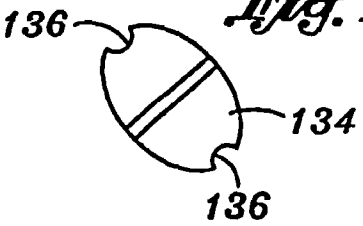
FIG. 18 is a perspective view of a diverter of the lubricating system illustrated in FIG. 17

As illustrated in FIG. 18, each flow directing element 134 includes a cut-out 136 at each end. When the flow directing elements 134 are located in the main passage 122, they substantially obstruct the main passage 122 except for the cut-out areas 136, which areas define a passage through which lubricant may flow. Details of the operation of the lubricating system are provided below in conjunction with FIGS. 24 and 25.

Figure 21:
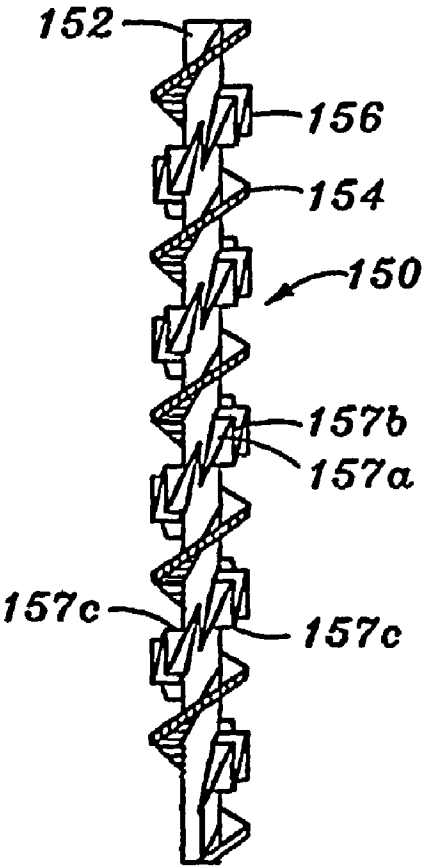
FIG. 21 is a plan view of a diverter of the lubricating system illustrated in FIG. 20.
Figure 20:
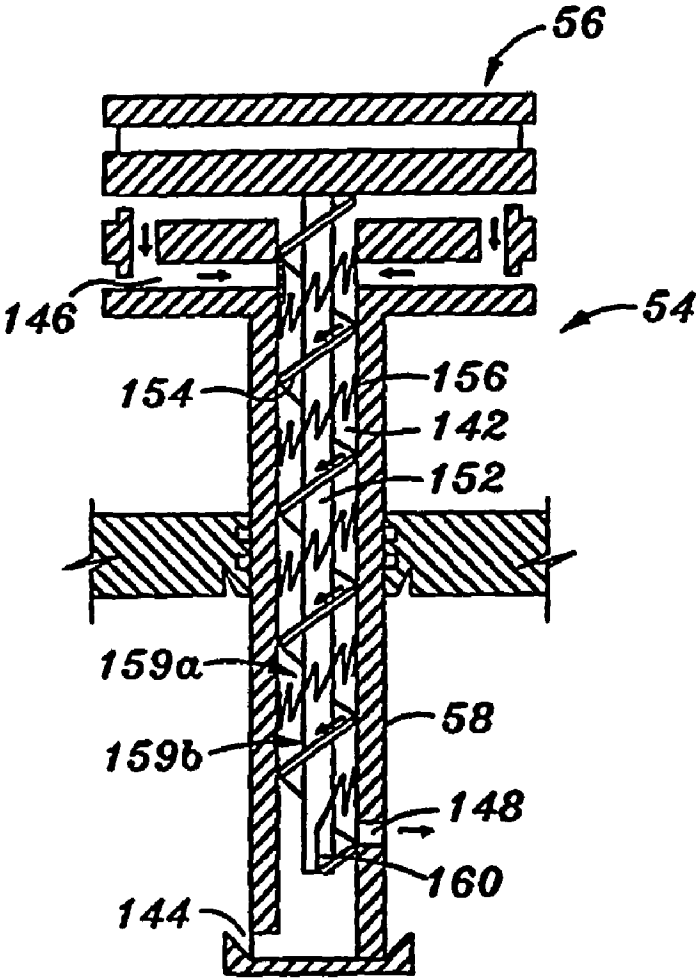
FIG. 20 is a is a cross-sectional view of a piston including a lubricating system in accordance with another embodiment of the invention.

Another embodiment of a lubricating system for a piston is illustrated in FIGS. 20 and 21. Similar to the lubricating system described above, at least a portion of each piston head 56 is hollow or has one or more passages there through. The piston 54 again includes a main passage 142 through the rod 58. An inlet 144 is provided from the exterior of the rod 58 to the main passage 142. At least one delivery passage 146 extends from the main passage 142 in the rod 58 through the piston head 56 to an outer area thereof for delivering lubricant to the rings 60. The delivery passage 146 preferably extends back to the main passage 142. An outlet 148 is provided from the main passage 142 to the exterior of the rod 58.

In accordance with the invention, there is provided a means for moving lubricant through the main passage 142 to the delivery passage 146 to the rings 60. In a preferred embodiment, the means comprises a linear pump cell 150. The linear pump cell 150 is located in the main passage 142 of the rod 58. The linear pump cell 150 comprises a support 152, a divider 154, and at least one flow directing element 156.

Referring to FIG. 21, in a preferred embodiment the support 152 comprises a rod or similar member. The dimension of the support 152 permits it to fit within the main passage 142 but leave substantial space between it and the rod 58 in which the passage 142 is formed.

The divider 154 comprises a helical wall which extends along the length of the support 152 and which extends outwardly therefrom. The divider 154 preferably extends outwardly from the support 152 a distance which causes it to abut the inside of the main passage 142 when the pump cell 150 is located therein. In this configuration, the divider 154 cooperates with the rod 58 and the support 152 to form a generally helical main passage 142.

The at least one flow directing element 156 comprises a stepped or laddered flow director. In a preferred embodiment, the flow directing element 156 extends in helical fashion around the rod 58. The element 156 is located in the helical passage 142 defined by the rod 58 and divide 154, further dividing the passage into a pair of passages 159*a,b*.

The element 156 includes alternating upwardly extending walls 157*a* and downwardly extending walls 157*b*. The upwardly extending walls 157*a* are slanted and extending upwardly a greater distance than the downwardly extending walls 157*b*. Preferably, the downwardly extending walls 157*b* are nearly vertical.

A trough 157*c* is formed at the intersection of each upwardly extending wall 157*a* and downwardly extending wall 157*b*. As described below, these troughs 157*c* hold lubricant in transport along the elements 156.

One of the passages 159*a* has its inlet in communication with the inlet 144 to the interior of the rod 58. This passage leads to the delivery passage 146.

The other of the two passages 159*b* leads from the delivery passage 146 to the outlet 148. In one embodiment, walls 160 are provided for dividing or sealing the passages 159*a*, 159*b* from one another.

Details of the operation of this embodiment lubricating system are provided below in conjunction with FIGS. 26–29.

Figures 22A, 22B, 22C, 22D, 22E, 22F:
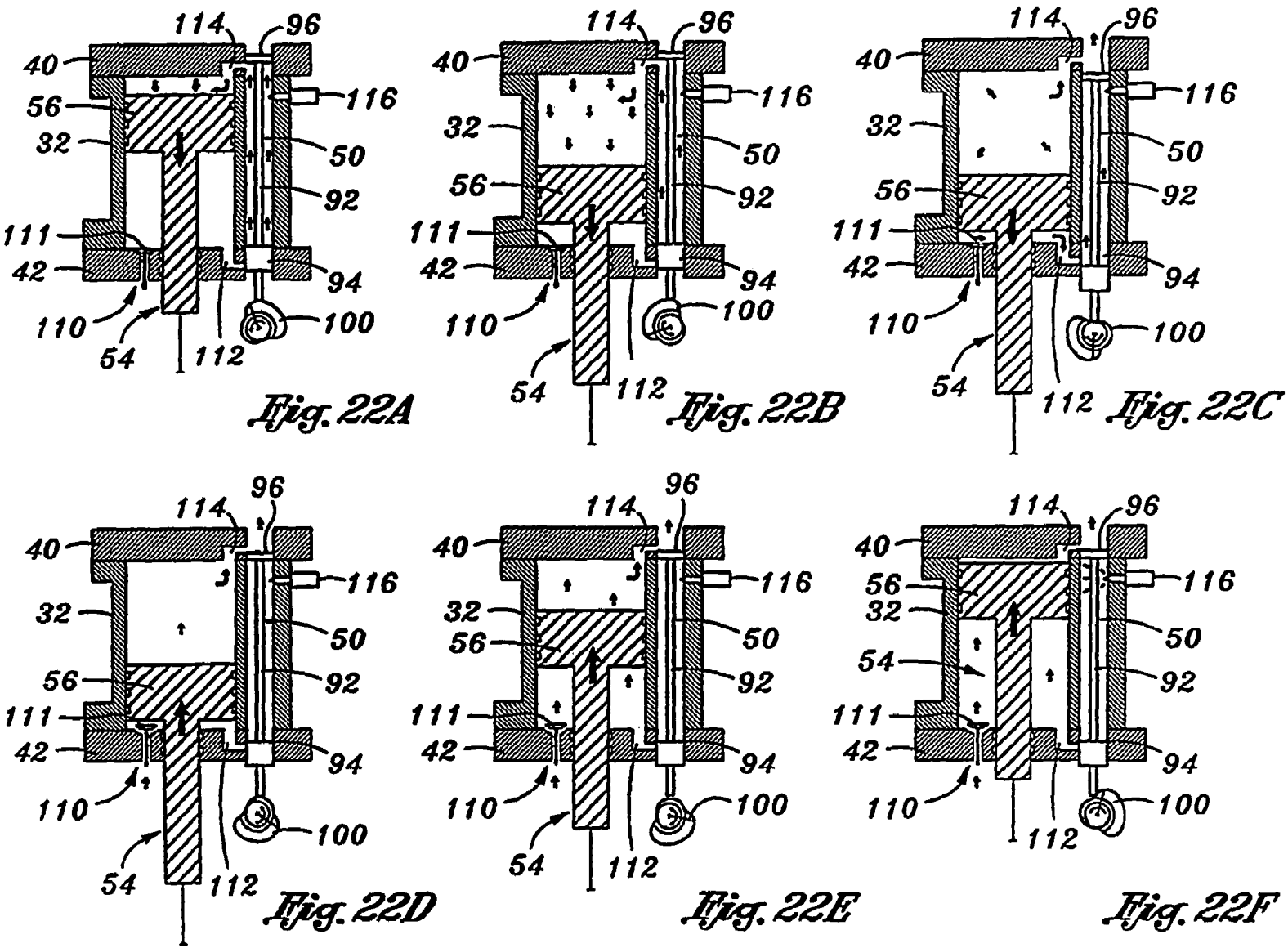
FIGS. 22A–F are a series of figures illustrating an engine cycle of the engine of the present invention.

Operation of the engine 20 described is as follows. In the description of the combustion cycle of the engine 20, with reference to FIGS. 22A–F (shown in general schematic form and not in exacting detail to the preferred embodiment of the invention described above and illustrated in FIGS. 1–21), reference is made to only a single cylinder of the engine 20. Referring to FIG. 22A, the piston 54 of the cylinder is illustrated just after it has reached its top dead center position and has begun to move downwardly. At this time, the area below the piston head 56 is filled with a fresh air charge. As noted, the cylinder head 32 and piston 54 cooperate to define a variable volume chamber below the piston head 56. At the point in time illustrated, this chamber is sealed, as the pressure of the air within the chamber has caused the valve 111 associated in the intake port 110 to close. In addition, the first seal 94 of the valve 92 is in a position in which it has closed the compression port 112, preventing the escape of air to the combustion chamber 50. As the piston 54 moves downwardly, the air within this variable volume chamber is compressed, raising its pressure.

In a preferred embodiment, combustion of the air and fuel begins in the combustion chamber (such as described below, via initiation with heat of compression or a spark plug). Thus at the time illustrated, the pressurized air and fuel mixture formed within the combustion chamber 50 which has already begun to ignite or burn flows into the variable volume combustion chamber located above the downwardly moving piston head 56. The fuel and air charge flows through the bi-directional port 114 as at this time the second seal 96 of the valve 92 is positioned above the port 114, and at the same time closes the exhaust pathway through the cylinder head cap 40. The burning of the charge causes the rapidly burning and expanding fuel and air mixture to force the piston 54 downwardly. The downward force of the piston 54 is used to drive the crankshaft 28, as is known in the art of reciprocating piston type internal combustion engines.

FIG. 22B illustrates the piston 54 as it is forced downwardly in a power stroke towards its bottom dead center position. At this time, the fresh air charge under the piston head 56 has been significantly compressed to a high pressure. The fuel and air charge above the piston head 56 has substantially completed combusting and expanding. During the movement of the piston 54 from near its top dead center to near its bottom dead center it will be seen that the valve 92 remains in a relatively constant position. It is noted that as the piston 54 moves downwardly, the pressurized and combusting fuel and air charge from within the combustion chamber 50 flows into the cylinder.

FIG. 22C illustrates the piston 54 at nearly its bottom dead center position. At this time, rotation of the cam 100 to a new profile area has resulted in movement of the valve 92. As illustrated, the valve 92 has been permitted to move downwardly with respect to the cylinder head 32. The first seal 96 is in a position in which it no longer obstructs the compression port 112. At the same time, the second seal 98 has moved into a position in which is obstructs a top portion of the pre combustion chamber 50, sealing it from the bi-directional port 114.

When the first seal 94 moves into a position in which is no longer obstructs the compression port 112, the compressed fresh air charge flows into the lower pressure combustion chamber 50. Thus, the combustion chamber 50 is filled with a charge of fresh air at high pressure.

At the same time, the combusted fuel and air charge above the piston head 56 is permitted to begin flowing from the combustion chamber through the bi-directional port 114 and the bore 52 in the head cap 40. Preferably, the exhaust flows into an exhaust pathway leading to a catalytic converter and muffler then to a point of discharge from the engine 20.

FIG. 22D illustrates the piston 56 after it has reach its bottom dead center position and has begun to move upwardly. At this time, the cam 100 has rotated to a position in which it has forced the valve 92 upwardly. The valve 92 has been moved upwardly a sufficient distance that the first seal 94 again seals or closes the compression port 112. However, the second seal 94 still seals the top of the combustion chamber 50, preventing escape of the fresh air charge in the combustion chamber. Importantly, at this time, the already mechanically pressurized fresh air charge within the combustion chamber is further pressurized. Heat of combustion from within the combustion chamber 50 from the previous cycle heats the newly introduced air in the combustion chamber 50. In addition, some heat from cylinder bore passes through the body of the cylinder head 32.

As the piston 54 moves upwardly, a condition of reduced pressure is created under the piston head 56. Higher pressure fresh air on the opposing side of the valve 111 moves the valve 111 into its open position, permitting fresh air to flow through the inlet port 110 into the chamber below the piston 54.

Movement of the piston 54 upwardly forces the combusted air and fuel exhaust from the combustion chamber. The exhaust continues to flow out through the bi-directional port 114.

FIG. 22E illustrates the piston 54 as it moves towards its top dead center position. Fresh air continues to be drawn into the area below the piston 54. The exhaust continues to be forced out of the combustion chamber through the bi-directional port 114.

FIG. 22F illustrates the piston 54 at nearly its top dead center position. As illustrated, at this time, the valve 92 is in generally the same position as previously illustrated. The combustion chamber 50 is sealed. Fuel is injected into the pressurized air charged in the combustion chamber 50. The fuel is injected with the fuel injector 116 or similar member. Preferably, ignition of the air and fuel within the combustion chamber 50 is then initiated, such as by a spark plug (not shown) or other ignition device.

The process then repeats at FIG. 10A, with the ignited fuel and air charge being released from the combustion chamber into the variable volume chamber above the piston 54.

Each piston 54 preferably moves through this same cycle. In a preferred embodiment where more than one cylinder and corresponding piston are provided, one or more of the pistons are preferably arranged to be at a different point in the combustion/exhaust cycle at the same time. In this manner, as one piston is in a non-power producing portion of its cycle, another piston is in the power stroke portion, thus rotating the crankshaft and aiding in the movement of the other piston through the portion of its cycle which is non-power producing.

Movement of the crankshaft 28 during operation of the engine 20 will be described with reference to FIGS. 23A–H. The crankshaft 28 is shown as viewed towards its first end 64. In FIGS. 23A–H, the first gear 68 at the first end 64 of the crankshaft 28 is shown as engaged with the first block gear 72. The first and second mounting portions 84,86 of the crankshaft 28 are also illustrated.

Figures 23A, 23B, 23C, 23D, 23E, 23F, 23G, 23H:
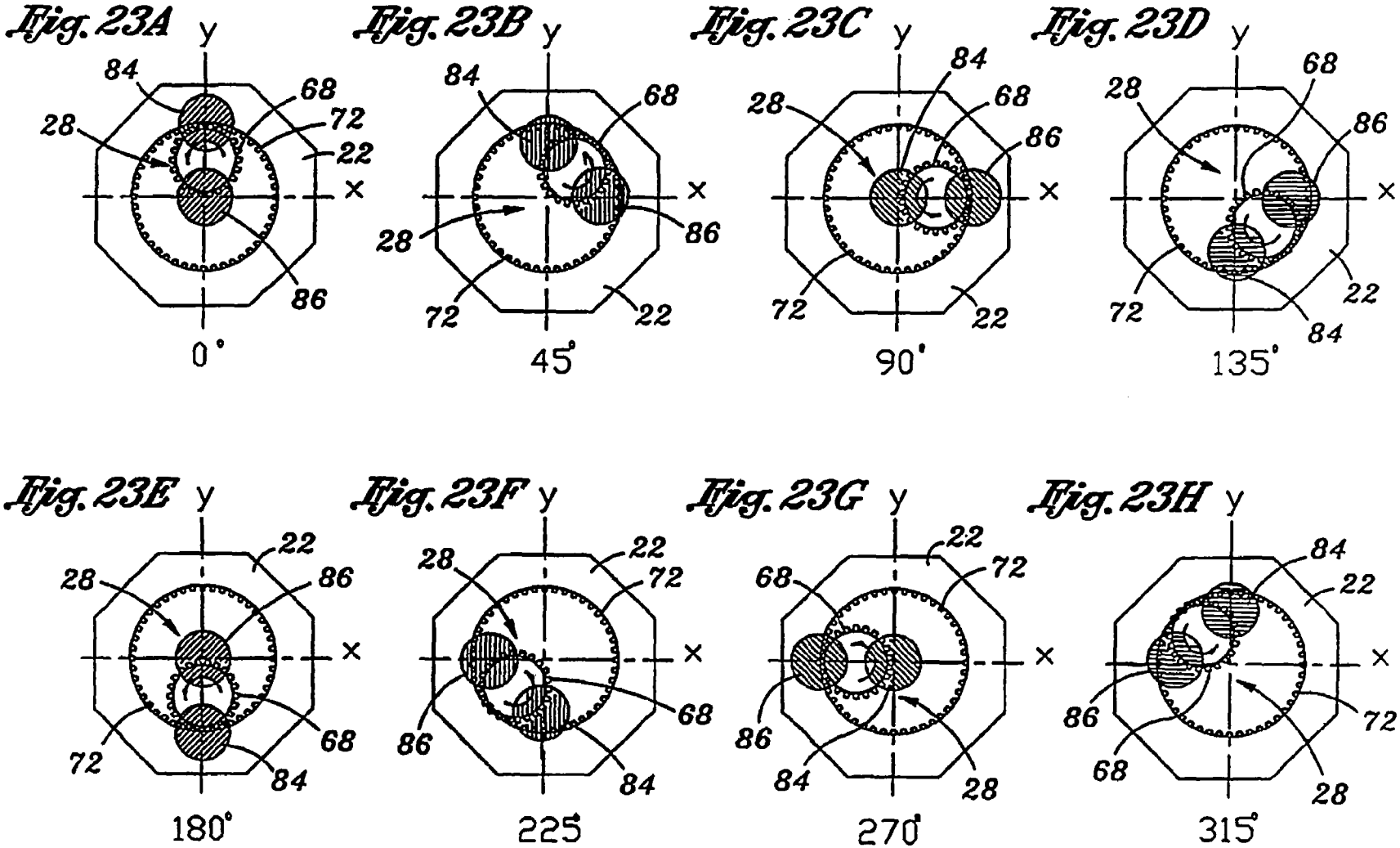
FIGS. 23A–H are a series of figures illustrating the movement of the crankshaft of the invention through a complete rotation thereof.

FIG. 23A illustrates the crankshaft 28 at an arbitrary position referred to as the 0 degree position. In this position, the first and second mounting portions 84,86 and the first end of the crankshaft 28 are all aligned vertically. As a result of a power stroke and exhaust stroke of the pistons associated with the first and second mounts 84,86, the first mounting portion 84 is driven downwardly, while the second mounting portion is driven outwardly. As a result, the crankshaft 28, which is rotating counter-clockwise, moves along the first block gear 72 in a clockwise direction. The crankshaft 28 is then in the position illustrated in FIG. 23B.

Further operation of the engine 20 causes the first mounting portion 84 to be driven downwardly until the first and second mounting portions 84,86 and first end 64 of the crankshaft 28 are all aligned along a horizontal axis, as illustrated in FIG. 23C.

The first mounting portion 84 is driven further downward while the second mounting portion 86 begins its return, moving in the opposite direction. The crankshaft 28 continues to rotate, with the first end 64 moving further clockwise around the first block gear 72 to the position illustrated in FIG. 23D.

Further movement of the crankshaft 28 occurs in like manner as illustrated in FIGS. 23E through 23H until the crankshaft 28 returns to its original starting position.

It will now be appreciated that in a preferred embodiment, the first pair of pistons 54 move cooperatively to move the first mounting portion 84 of the crankshaft 28. When one piston of that pair is moving downwardly in its power stroke, it is forcing the other piston upwardly in an exhaust stroke. Likewise, the other pair of pistons are associated with the second mounting member 86. Moreover, the first and second mounting portions 84,86 are offset so that the crankshaft 28 is translated, i.e. moved laterally or other than rotationally.

Because the crankshaft 28 translates, the attachment point of each piston 54 also moves, but a greater distance than if the crankshaft only rotated. In this configuration, the throw or maximum distance traveled by each piston 54 is great, even though the length of the piston rod is quite short.

Figure 24:
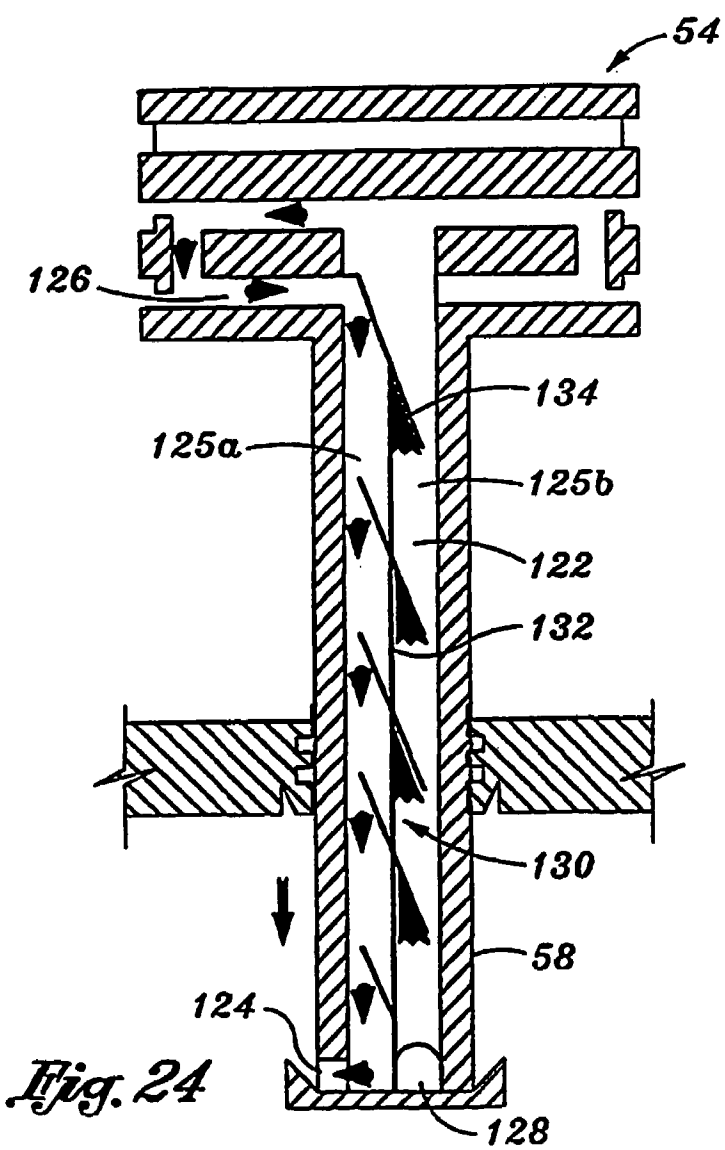
FIG. 24 is view of the piston illustrated in FIG. 16 shown moving downward and illustrating the movement of lubrication thereby.

Operation of the lubricating system for the pistons in accordance with the embodiment illustrated in FIGS. 16–19 will now be described in detail with reference primarily to FIGS. 24 and 25. In general, the operation of the lubricating system is in the nature of a linear pump. As the piston 54 moves downwardly, oil flows from the inlet 124 upwardly through the first passage 125*a* to the delivery passage 126. The upward flow occurs as lubricant passes through the cut-outs 136 in the elements 134. Notably, upward movement of oil from the outlet 128 through the second passage 125*b* is inhibited by the partition elements 132. The upward flow of oil forces oil through the various lubricating passages in the piston head and through lubricating weeps for lubricating the rings.

Figure 25:
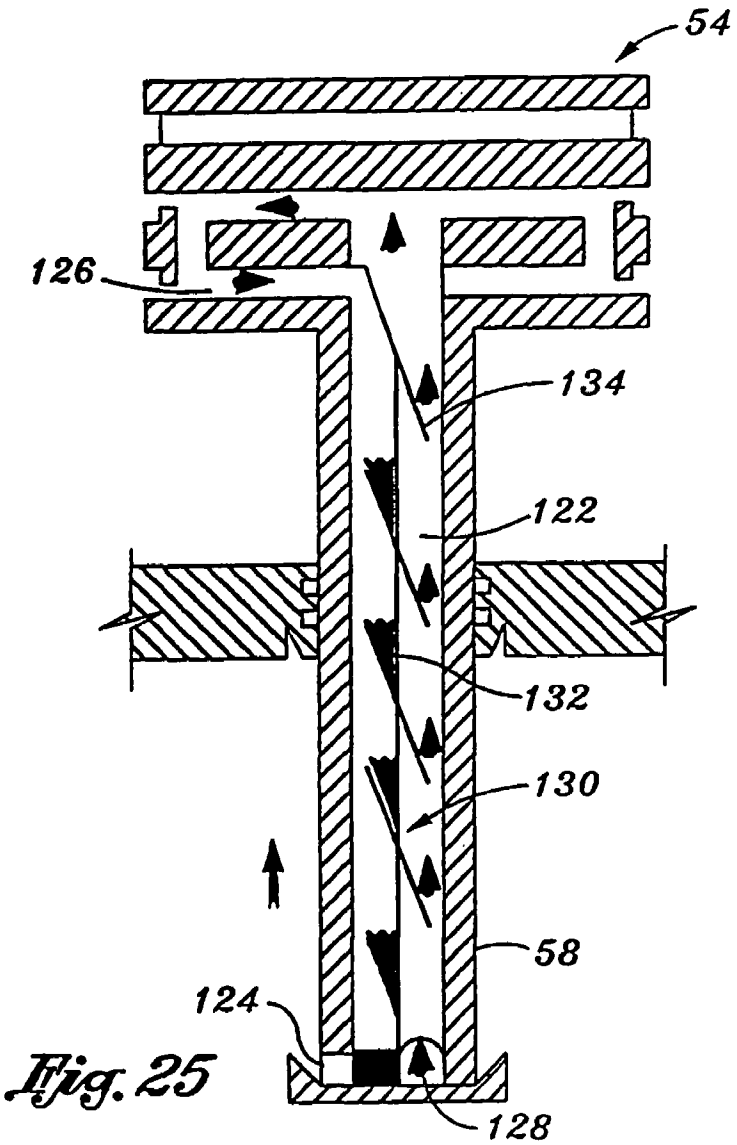
FIG. 25 is a view of the piston illustrated in FIG. 16 shown moving upward and illustrating the movement of lubrication thereby.

Referring to FIG. 25, as the piston 54 moves upwardly, oil is swept off of the piston rod towards the inlet 124. In addition, the inertial forces draw excess lubricant downwardly from the delivery passage 126 through the second passage 125*b* to the outlet 128. At the same time, downward movement of oil from the delivery passage 126 through the first passage 125*a* is inhibited by the partitions 132.

In this cycle, oil is provided to the inlet 124, is forced upwardly through the first passage 125*a* to the delivery passage 126 and weeps. Excess lubricant is then drawn back to the outlet 128.

Operation of the lubricating system for the pistons in accordance with the embodiments illustrated in FIGS. 20–21 will now be described in detail with reference to FIGS. 26–29.

Figure 27:
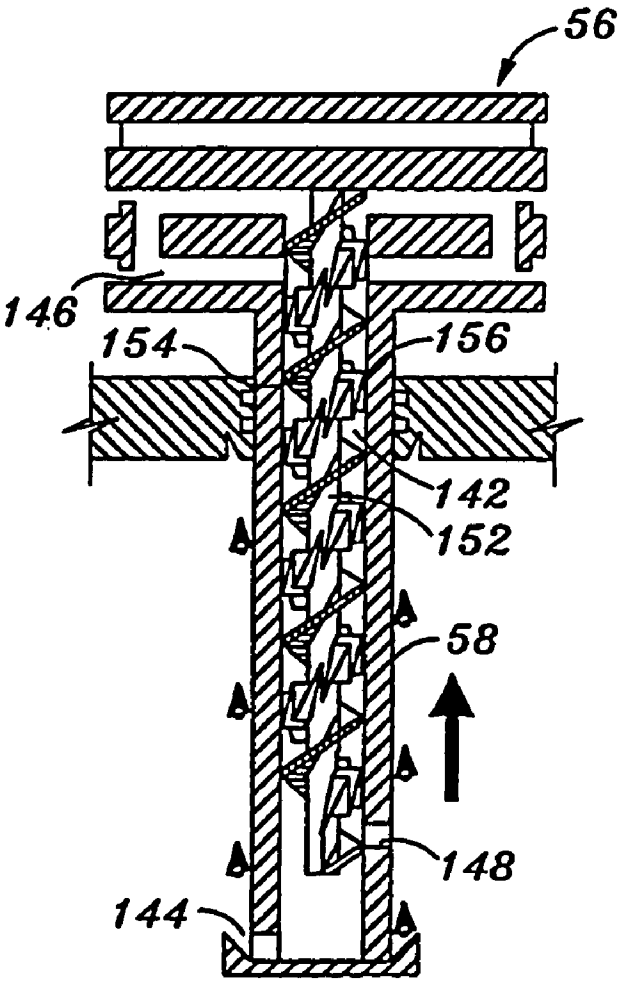
FIG. 27 is a view of the piston illustrated in FIG. 21 shown moving upward and illustrating the movement of lubrication thereby.

Operation of this embodiment system is similar to that described above. In this embodiment system, upward movement of the piston 56 causes lubricant to be directed into the inlet 124, as illustrated in FIG. 27. At this time excess lubricant is directed from the delivery passage 146 to the outlet 148 through the second passage 159*b*. As illustrated in greater detail in FIG. 28, downward flow of the lubricant from the delivery passage 146 to the inlet 144 is prohibited in that the lubricant is trapped by the troughs 157*c* in the first passage 159*a*.

Figure 26:
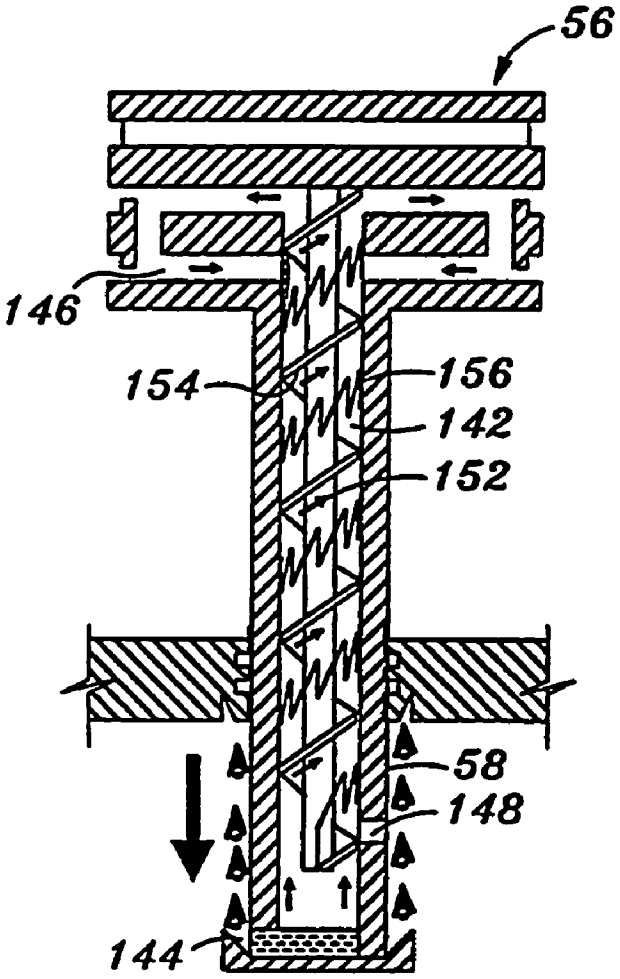
FIG. 26 is a view of the piston illustrated in FIG. 20 shown moving downward and illustrating the movement of lubrication thereby.
Figure 28:
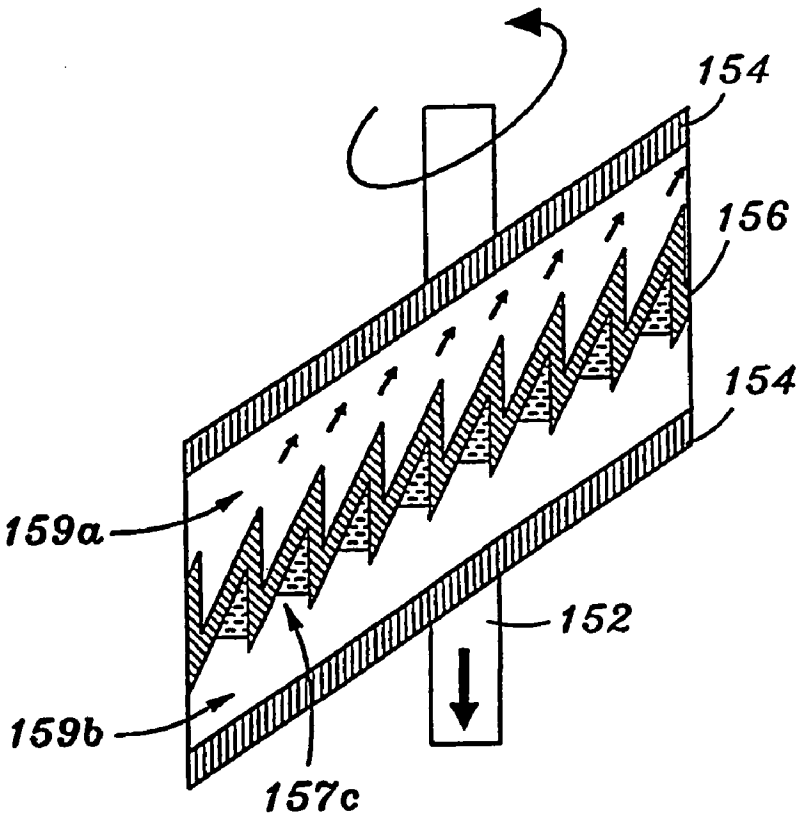
FIG. 28 is an enlarged view of a portion of the piston illustrated in FIG. 26.
Figure 29:
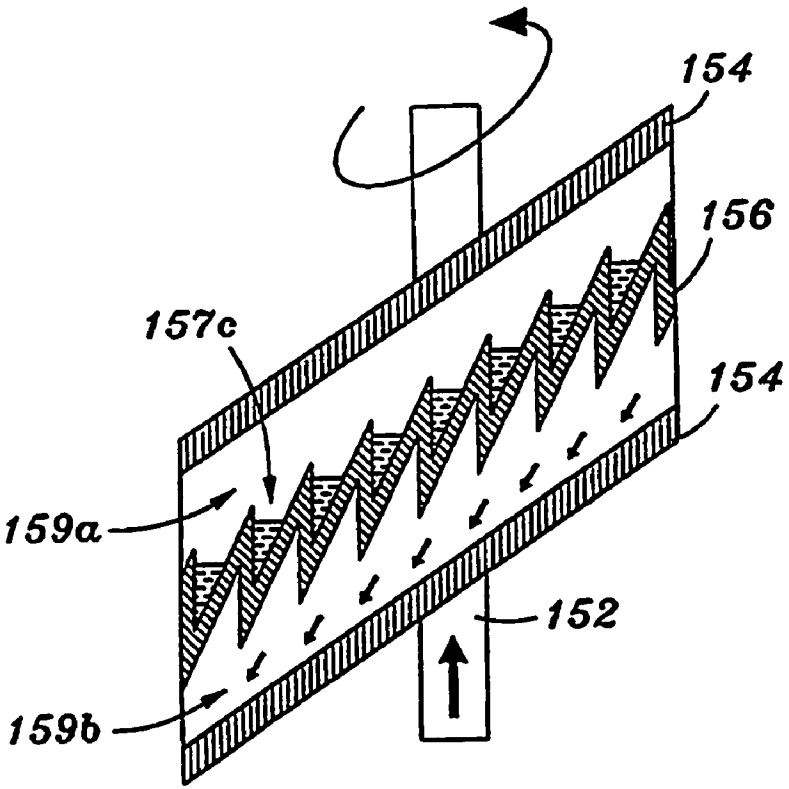
FIG. 29 is an enlarged view of a portion of the piston illustrated in FIG. 27.

Referring to FIG. 26, upon downward movement of the piston 56, lubricant delivered to the trough area and inlet 144 is directed upwardly to the delivery passage 146 through the first passage 159. As illustrated in greater detail in FIG. 29, lubricant is prohibited from moving from the outlet 148 back to the delivery passage 146 through the second passage 159*b* by the troughs 157*c* defined by the flow directing element 156.

Of course, the engine 20 need not be configured exactly as illustrated, and many alternate configurations are contemplated as within the scope of the invention. Further, one or more features of the invention may be used alone or in combination with other elements not described in detail herein.

In one embodiment, the engine 20 may have more than four cylinders or less than four cylinders. For example, the engine 20 may have two cylinders including two opposing pistons. The crankshaft and block of the engine 20 maybe elongate and for accommodating six cylinders and six pistons.

The lubricating system described above may be used in a variety of other environments or applications. For example, the lubricating system may be applied to a piston of a four-cycle internal combustion engine of the type now known.

The various components of the engine 20 may be constructed of a wide variety of materials. These materials may include, but are not limited to metal, ceramic and plastic.

The components of the engine 20 may vary from that described above. For example, the cylinder head 32 may be formed with an integral head cap or bottom plate. One or more portions of the cylinder head 32 may also be integrally formed with the block 22. In one arrangement, the bottom plate may actually be formed inside of the engine block, this portion of the engine block thus forming the lower portion of the cylinder.

The valves used to control the flow of air, air and fuel, and exhaust through the engine 20 may vary from that described. For example, electronically controlled valves, such as butterfly or rotating port valves may be utilized. Other means that the cam and follower arrangement may be utilized to move the valve 92. For example, the valve 92 may be moved with a motor.

One advantage to the configuration of the first and second seals 94,96 being of substantially the same size or surface area is that the pressure of the air within the combustion chamber 50 acting upon the seals 94,96 is generally the same. Thus, the pressure of the air does not tend to move the valve 92 in one direction or the other. It will be appreciated that, if desired, one seal or the other may be configured to be larger (and fit within a correspondingly larger portion of the cylinder head 32 defining the chamber 50) to bias the valve 92 into a particular position. For example, the second seal 96 maybe slightly larger than the first seal 94, so that when acted upon by an excessively high pressure, the valve 92 is moved upwardly to exhaust the air from the combustion chamber 50, acting similar to a relief valve.

The various shapes and sizes of the components of the engine 20 may vary. For example, the combustion chamber may have other than a generally circular cylindrical shape, such as an oval cylindrical shape.

Of course, a number of seals, connectors (such as nuts and bolts) and other elements may be used to achieve the objects of the invention. The particular elements used may depend upon the particular configuration of the engine 20.

The combustion 50 chamber and precombustion fuel and air mixing and combustion aspects of the invention maybe applied to engines configured other than as illustrated and described. For example, such an arrangement may be applied to engines having a single cylinder. The engine of the invention also need not include a combustion chamber 50 with each cylinder 32. Instead, the arrangement of the invention may be used with a cylinder having normal intake and exhaust porting as is known in the art.

Figure 31:
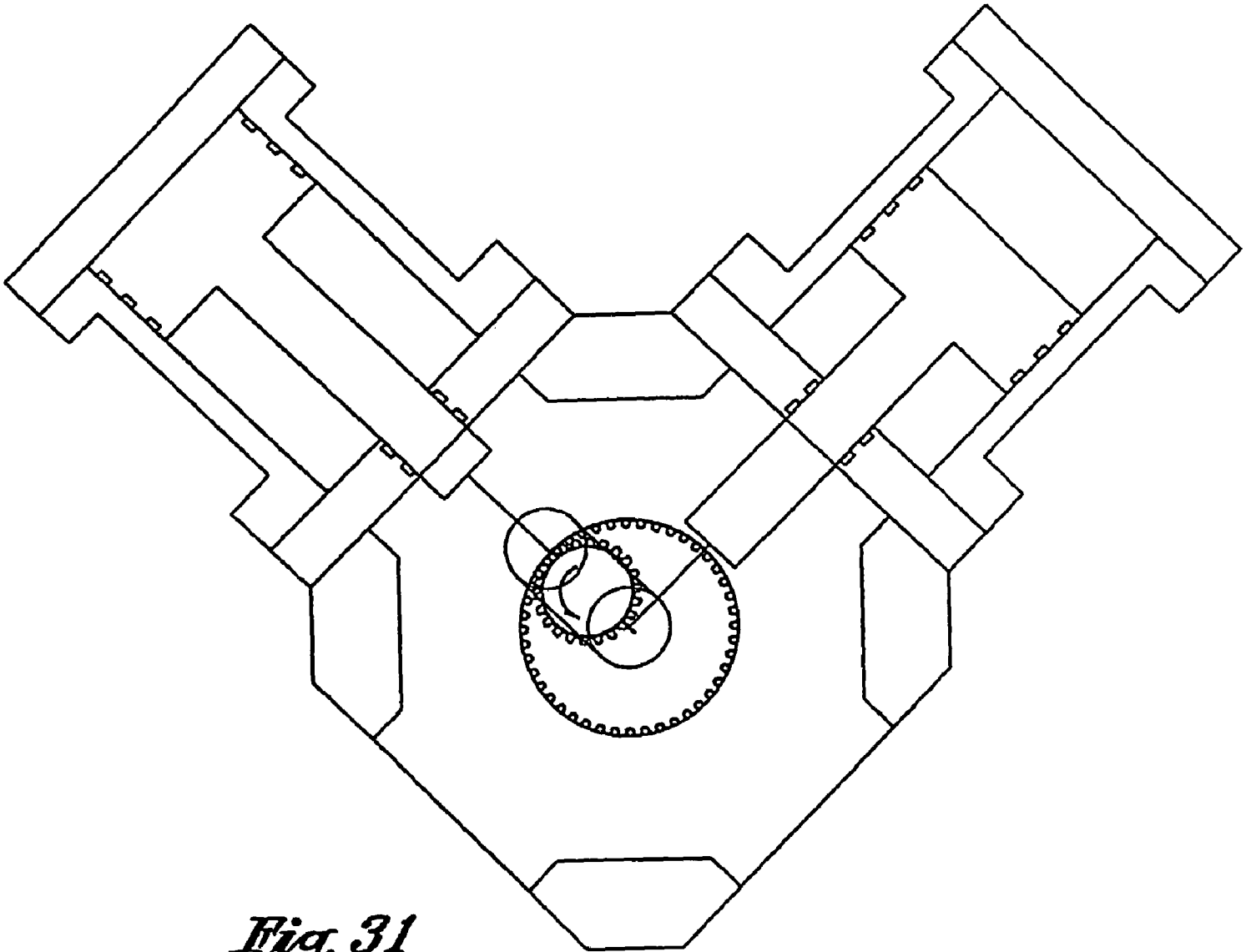
FIG. 31 illustrates an engine in accordance with an embodiment of the invention arranged in a "V" configuration.

In one embodiment, instead of mounting the pistons in pairs to mounting sections of the crankshaft, each piston may be mounted to a different section of the crankshaft. Such an arrangement is advantageous where there are two cylinders or where it is desired to provide a number of cylinders in the same plane. Such an arrangement where the pistons are mounted in a "V" arrangement is illustrated in FIG. 31.

In one embodiment, engine control or management devices or systems may be employed. For example, an oxygen (O2) sensor may be used to monitor the exhaust of the one or more cylinders. The O2 sensor feedback may be used to control the timing and duration of fuel injection or spark timing.

The start of combustion of the fuel and air mixture may be either in the cylinder bore or in the separate combustion chamber. As described above, in a preferred embodiment, combustion is initiated in the combustion chamber. In this arrangement, combustion is initiated only shortly before or nearly at the same time the valve 92 is moved upwardly (to prevent damage to the combustion chamber due to overexpansion).

The engine may include other features. For example, a turbo charger or supercharger may be used to pre-compress the intake air. An intercooler may be used to cool the incoming air so that it may be compressed to a higher density.

The principles of the invention may also be applied to an engine having a crankshaft which is non-translating (i.e. rotates about a fixed axis). In such event, however, the length of the rods and cylinder bores may be appropriately adjusted to permit the pistons to move a full range of motion and provide a desired compression ratio.

The embodiments of the invention have numerous advantages. As with conventional two-cycle internal combustion engines, one advantage is that a high power output is realized because each piston has a power stroke every cycle (instead of every other cycle as in a four-stroke engine). On the other hand, problems associated with conventional two-stroke or two-cycle engines are overcome.

First, problems associated with incomplete scavenging in two-cycle engines are overcome. A fresh air charge is not drawn into the cylinder while the exhaust is being exhausted. Instead, the exhaust is completely exhausted during the upward stroke of the piston. Only then is a fresh air charge admitted into the cylinder.

Unlike convention engines, combustion need not begin before the piston reaches top dead center, and thus there is no robbing negative force upon the upwardly rising piston. Instead, combustion may begin after the piston reaches top dead center. In part, this is due to the fact that combustion is permitted during nearly the entire downward stroke of the piston. In addition, because combustion begins in the combustion chamber (which is separate from the cylinder containing the piston), the air and fuel mixture may combust and expand, generating a very high pressure. The highly pressurized mixture is preferably released when it reaches a maximum and at piston top dead center for maximum efficiency.

A higher engine efficiency is realized because the air and fuel charge which is admitted into the cylinder for combustion is at high heat and high pressure. As noted, the fresh air charge is first mechanically compressed by the piston and then thermally compressed within the combustion chamber. The highly heated and compressed air charge permits more complete burning of fuel and greater energy output during combustion.

Figure 30:
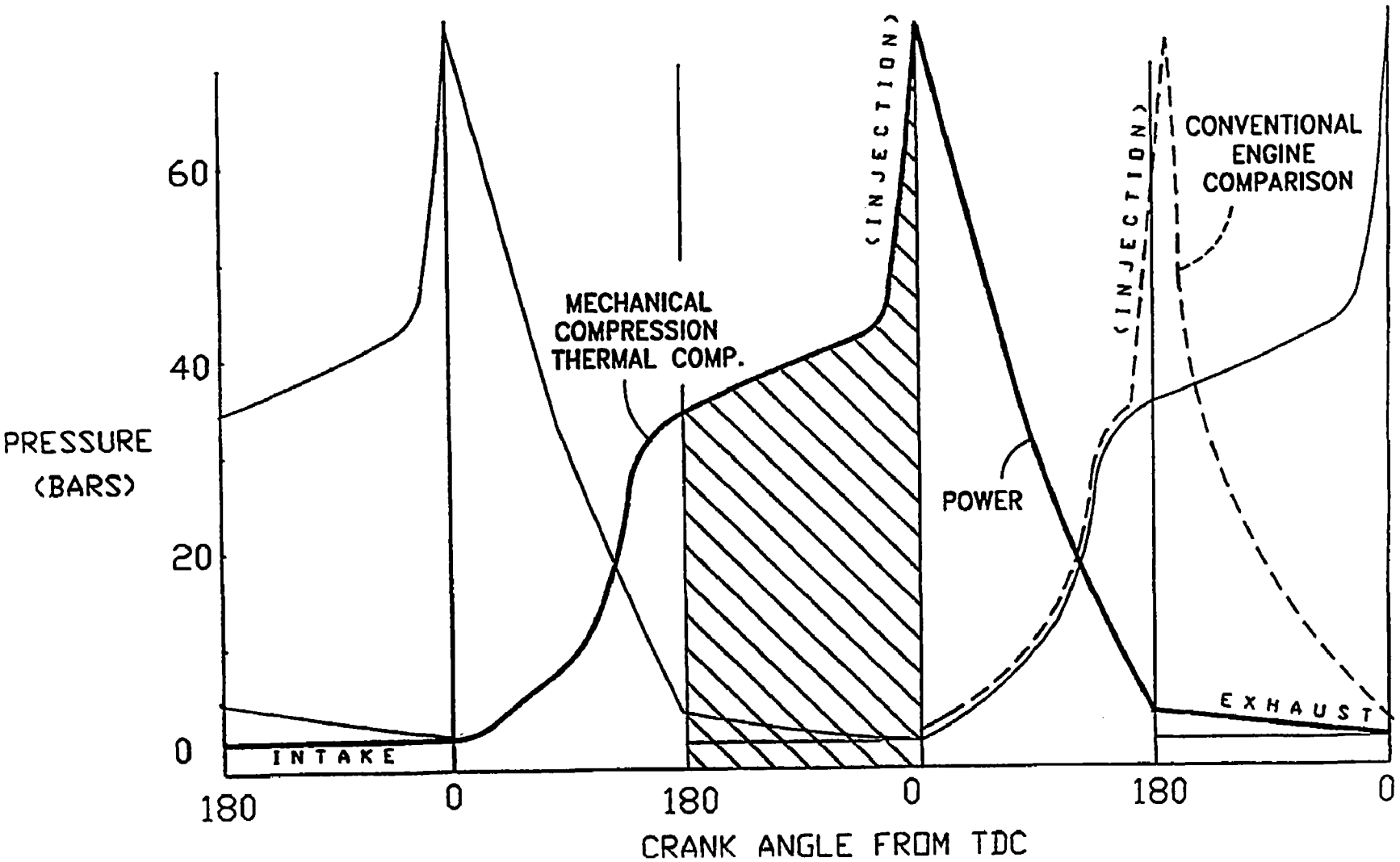
FIG. 30 is a chart illustrating engine pressure versus crankshaft angle during operation of the engine in accordance with the invention.

FIG. 30 is a graph which illustrates pressure of an air charge as it moves through the engine. As illustrated, the air charge enters the intake at substantially ambient pressure. The air charge is the compressed mechanically with the piston, and then thermally by the heat within the combustion chamber. After fuel injection and delivery to the cylinder, the pressure beings to fall as the fuel and air are converted to mechanical energy. By comparison, in a conventional engine greater power is derived as a result of the higher temperatures and pressures and more complete burning of the fuel.

The engine is capable of operating at high speeds. The rods 54 are short, reducing destructive inertial forces. This is due, in part to the translation of the crankshaft 28. Because the crankshaft translates, the piston mounting portion 86 more toward and away from the cylinder during the upward and downward movement of the pistons as a result of the rotation of the crankshaft. As a result, the piston rods 54 can be shorter while a large compression ration is still realized.

The lubricating system as described provides for efficient lubrication of the pistons without the need for complex mechanically or electrically powered pumps, external lines, coolers and similar elements. In addition, the lubricating system has the advantage that it is useful in cooling the pistons.

Another embodiment engine in accordance with the invention will be described with reference to FIGS. 32–42. Similar to the engine 20 just described, the engine 200 comprises at least one first chamber in which admission/compression of intake gas occurs, at least one second chamber where heating of air and combustion of fuel with air is initiated and occurs, and at least one third chamber in which combustion gasses expand to move a piston and are then expelled.

In one embodiment, the second and third chambers are again located on either side of a piston which is located in a cylinder. The piston is configured to reciprocate within the cylinder, moving in one direction in response to expanding combustion gasses and compressing gas for a next combustion cycle, and moving in an opposite direction to exhaust combustion gasses and intake fresh gas for compression. Preferably, reciprocation of the piston effects rotation of the piston, which rotation drives an output shaft.

Figure 32:
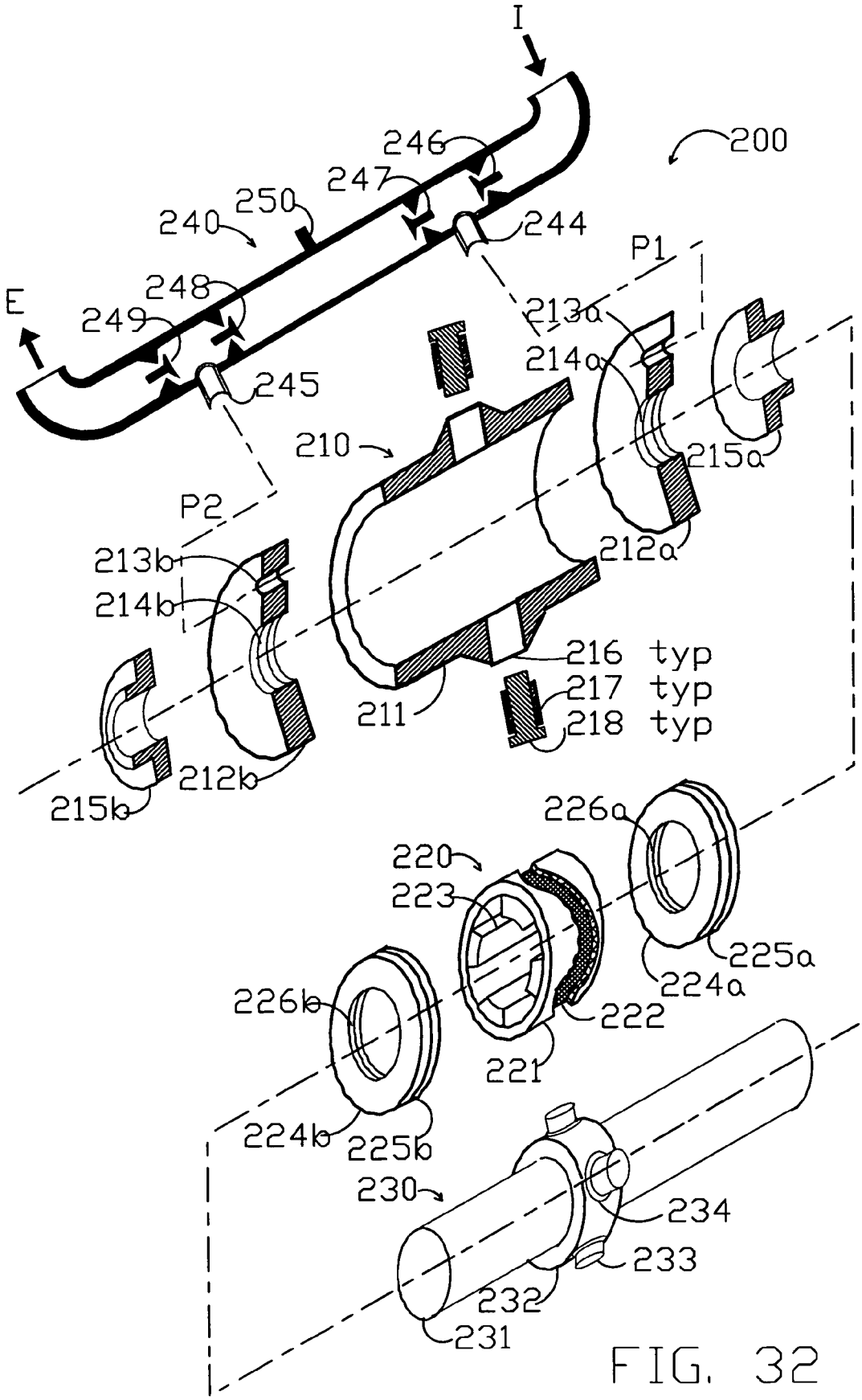
FIG. 32 is an exploded view of an engine in accordance with another embodiment of the invention, various portions of the engine show in cross-section.
Figure 36:
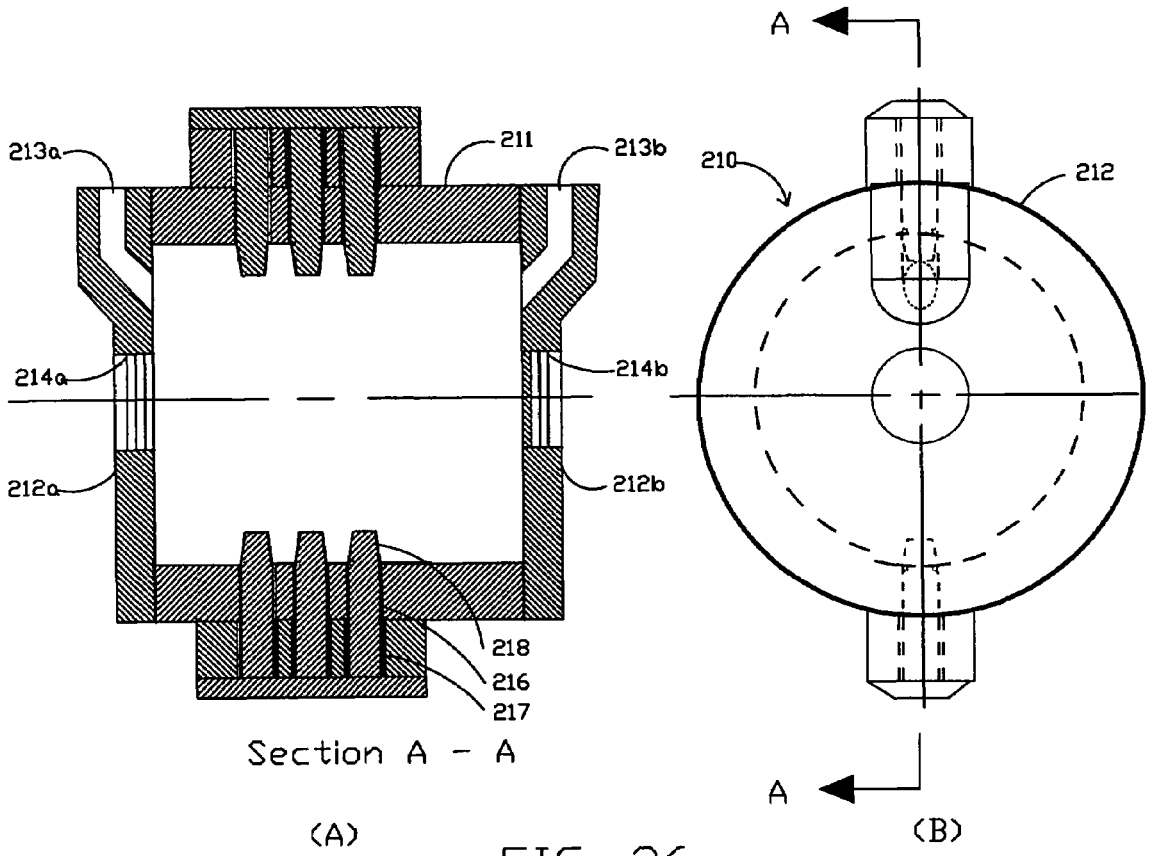
FIGS. 36A–B are top and cross-sectional view of a cylinder of the invention illustrated in FIG. 32, the cylinder including cam leaders for engaging a cam slot in a piston.

Referring to FIGS. 32 and 36, in one embodiment, the engine 200 includes at least one cylinder 210. In one embodiment, the cylinder comprises a wall 211 or other body, block, housing or the like which defines a piston-accepting passage. Preferably, the cylinder 210 defines a cylindrical passage and is closed at both ends. In one embodiment, the cylinder 210 is closed at first and second ends by plate covers 212*a,b*, or heads, thus defining a generally closed interior space or chamber.

These two covers 212*a,b* or heads are provided with passages or holes 214*a,b* for accepting a main shaft 230. The covers 212*a,b* also preferably support bearings 215*a,b* which rotatably support the main shaft 230. One or more seals (not shown) preferably seal the main shaft 230 where it passes through the passages 214*a,b* in the covers 212*a,b*.

Preferably, each cover 212*a,b* defines at least one port 213*a,b*. As described below, these ports 213*a,b* connect to ducts or passages leading to a combustion chamber of the engine 200.

Figure 34:
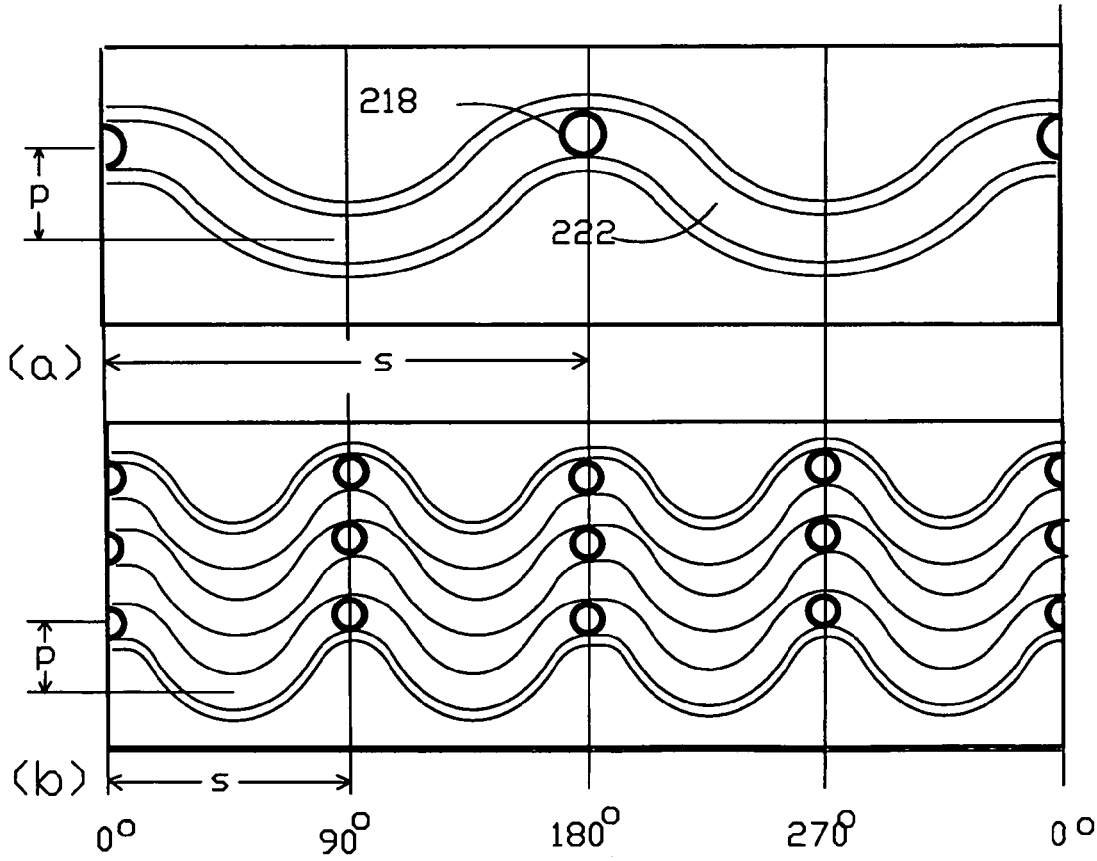
FIGS. 34A–B illustrate embodiment and development of a piston cam slot in accordance with the invention.
Figure 35:
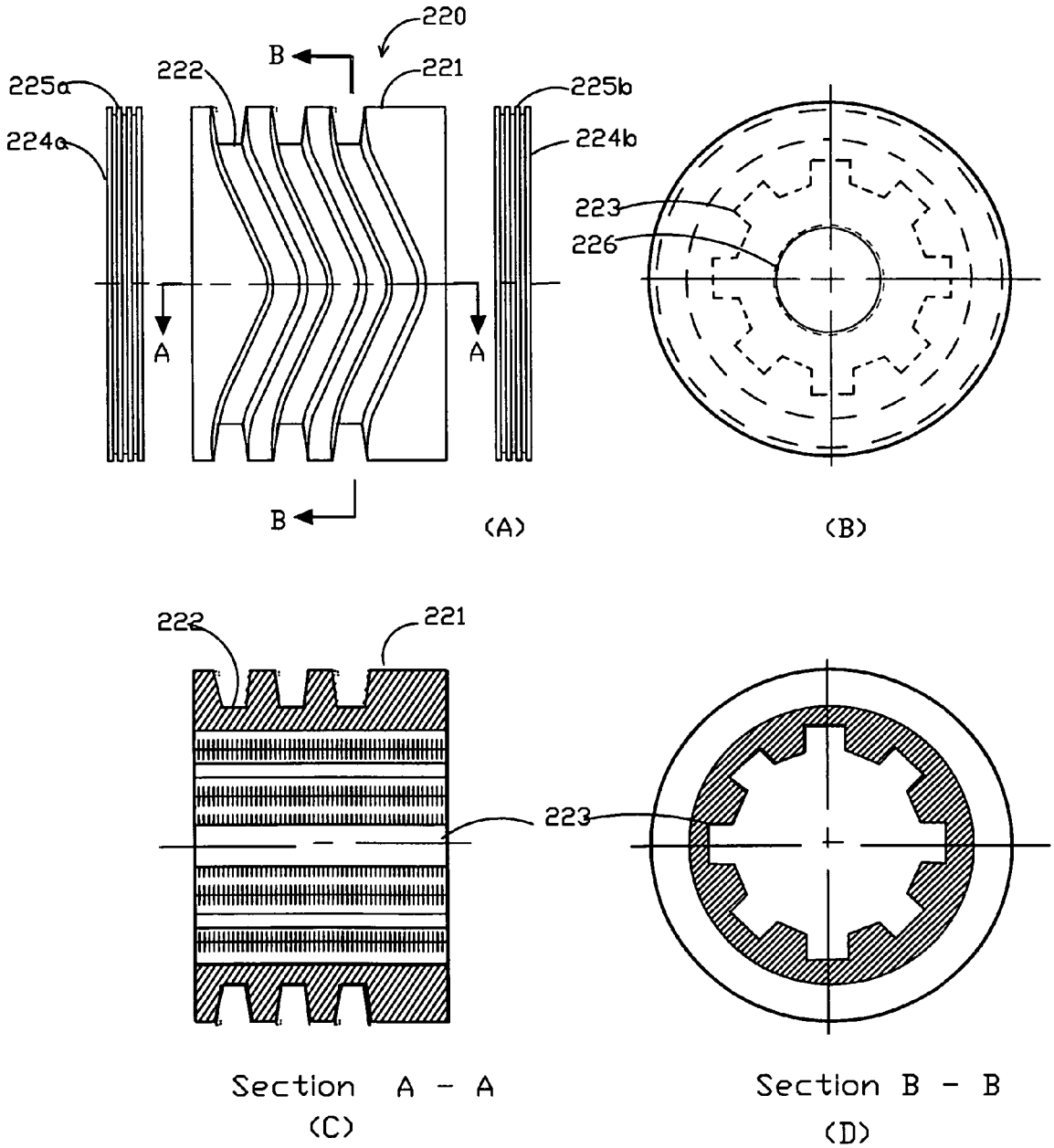
FIGS. 35A–D illustrate a piston of the engine illustrated in FIG. 32.

Referring to FIGS. 32, 34 and 35, a piston 220 is located in the cylinder 210, the piston dividing the interior of the cylinder into two variable-volume chambers. One chamber is referred to as the power/exhaust chamber and the other the admission/compression chamber. The piston 220 is preferably a cylindrically-shaped body which is shorter than the length of the cylinder body 210, and which has a maximum outer diameter dimension which is close in dimension to the inner diameter of the cylinder body. The piston 220 defines a central passage and, in one embodiment, is open at each end. In this embodiment, the piston 220 includes covers or caps 224*a,b* located at both ends of a body portion 221. These covers 224*a,b* are provided with sealed passages or holes 226*a,b* for accepting the main shaft 230 in a manner permitting the piston and covers or caps to move relative to the shaft 230. Preferably, one or more rings 225 are provided on the exterior of the covers 224*a,b* or the piston 220 in order to provide a seal between the piston and the cylinder 210, in a manner described above relative to engine 20.

Preferably, the piston 220 is configured to both reciprocate within the cylinder 210 and rotate within the cylinder. As described below, reciprocation of the piston 220 causes the volumes of the chambers on either side of the piston 220 to vary. The reciprocation of the piston 220 also effects rotation of the piston 220 which, as described below, causes the piston 220 to rotationally drive the main shaft 230.

Referring to FIGS. 32 and 36, the cylinder 210 also includes one or more passages or openings 216 in the wall 211 thereof leading to the interior space. As described in more detail below, openings 216 are preferably symmetrically located about the cylinder 210 to support cam followers or, in this case, cam leaders 218. As illustrated, the cam leaders 218 are short shafts or pins mounted on bearings 217, and are configured to engage and guide the piston 220. The cam leaders 218 preferably engage one or more curved cams 222 in the exterior of the piston 220, causing the piston to rotate when it reciprocates.

Figure 33:
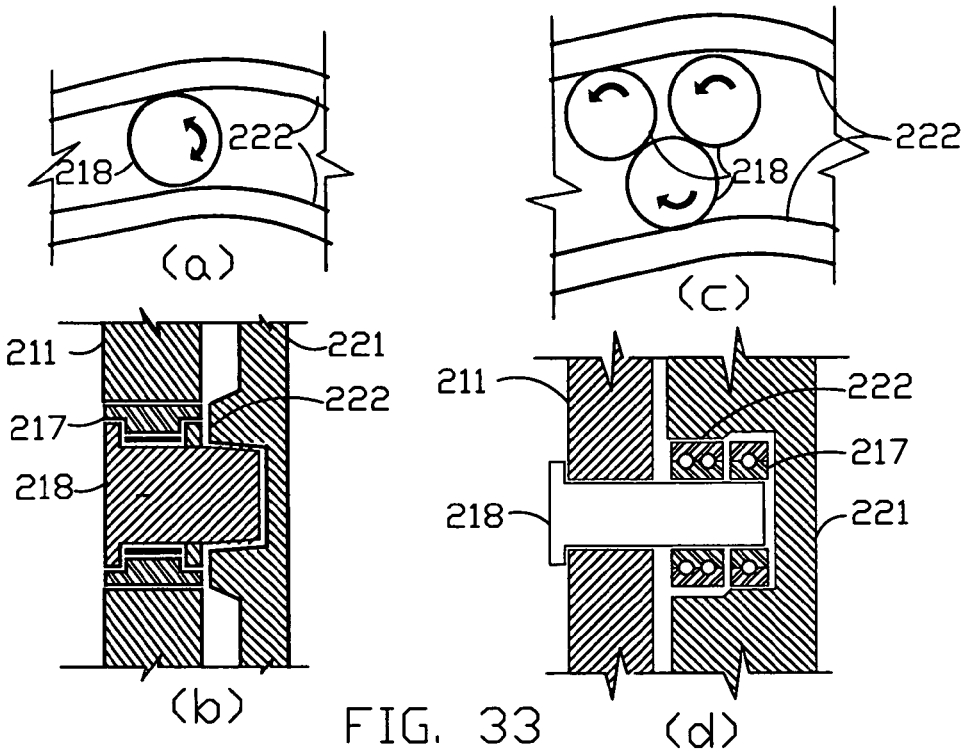
FIGS. 33A–D illustrate embodiments of a cam leader and piston cam slot in accordance with the invention.

One embodiment of a cam leader 218 is illustrated in FIG. 33(*b*). In one embodiment, individual cam leaders 218 are mounted for rotation relative to the cylinder wall 211 via a bearing 217. In another embodiment, as illustrated in FIG. 33(*c*), multiple cam leaders 218 may be configured to support and rotate with one another. In FIG. 33(*d*), individual cam leaders with two bearings engage a special cam with two lips, one upper external and another lower internal so one bearing receives the downward force of the piston while the other receives the upward force of the piston.

Referring to FIGS. 32 and 35(*a*) and (*b*), the at least one curved cam 222 is preferably located on the exterior or periphery of the piston 220 and comprises a slot or recess. Preferably, the cam 222 is a curvilinear slot. In a most preferred embodiment, the cam follows a path of a periodical sine-type wave form. One or more cam leaders 218 are configured to engage each curved cam 222. Preferably, each curved cam 222 extends or traverses the entire periphery of the piston 220, thus forming a closed loop.

The design of the at least one curved cam 222 may vary when considering the following factors. First, by dividing the length of the cam 222 into equally shaped segments, the speed of rotation of the main shaft 230 as affected by rotation of the piston 220 may be proportionately reduced. Second, by varying the shape of the segments of the curved cam 222, the power/compression stroke of the piston 220 can be changed relative to the length of the admission/exhaust stroke. Lastly, because the displacement of the piston 220 is not subjected to motion of a circular crankshaft, the linear speed of travel of the piston may be selected to match that which is most efficient relative to expanding combustion gases.

In one embodiment, a number of curved cams 222 may be located sequentially along the piston 220. The number of curved cams 222 on the piston 220 is preferably dictated by the stresses of the piston forces on the cams. FIG. 34(*a*) illustrates one embodiment where the piston 220 includes a single curved cam 222. FIG. 34(*b*) illustrates an embodiment where the piston 220 includes three curved cams 222. Of course, the piston 220 might include any number of curved cams from a single cam to two, three or more.

FIGS. 34(*a*) and (*b*) also illustrate different configurations for the curved cams 222. FIG. 34(*a*) illustrates one embodiment where curved cam 222 is a two-segmented cam that, for each reciprocating or cycle of the piston 220, causes the piston 220 and thus the associated main shaft 230, to rotate ½ of a revolution. In this figure, (s) represents the length of each segment and the distance (p) is the length of the piston stroke. FIG. 34(*b*) illustrates an embodiment where the curved cams 222 each are four-segmented, such that for each reciprocation or cycle of the piston 220, the piston and main shaft rotate ¼ of a revolution.

It will be appreciated that the number of cam leaders 218 may vary, such as depending upon the number of curved cams 222. In one embodiment, a cam leader 218 is provided for each segment of curved cam 222. Thus, in the example of FIG. 34(*a*) where there is a single curved cam 222 with two segments, there are two cam leaders 218 which are located on opposing sides of the cylinder 210. In the example illustrated in FIG. 34(*b*), there are three curved cams 222 each with four segments, so there are preferably twelve (12) cam leaders 218. These cam leaders 218 are located about the cylinder 210 peripherally as well as linearly.

Figure 37:
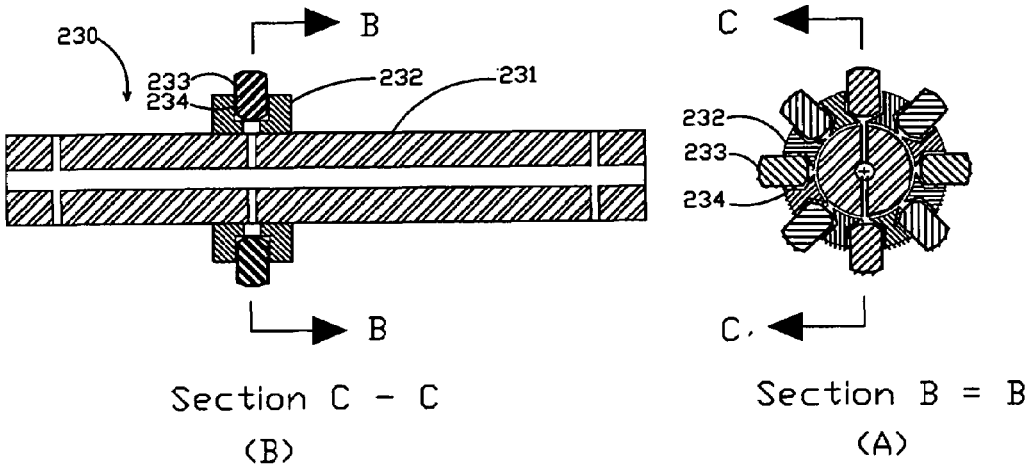
FIGS. 37A–B are cross-sectional views of an output shaft of the engine illustrated in FIG. 32.

Preferably, as illustrated in FIGS. 32 and 35(*c*) and (*d*), one or more straight cams 223 are located inside the piston 220. These straight cams 223 transmit the rotational motion of the piston 220 to the main shaft 230 through a number of cam followers 233 mounted on the shaft, but at the same time allow the piston 220 to move along the shaft 230 relative thereto as it reciprocates. As best illustrated in FIGS. 37(*a*) and (*b*), the main shaft 230 is an elongate, preferably generally cylindrical shaft 231 that has a fixed ring 232 which supports the cam followers 233. The cam followers 233 are preferably mounted to the fixed ring 232 by one or more bearings 234. Other means maybe provided to connect the piston to the shaft in a manner in which the piston rotates the shaft. For example, in one embodiment, slots might be formed in the shaft for engagement by followers mounted on the piston.

Referring again to FIG. 32, the engine 200 includes a combustion chamber 240. In one embodiment, the combustion chamber 240 is a walled body which defines a cylinder-shaped interior space. Preferably, the combustion chamber 240 includes a main intake I and a main exhaust E. In addition, the combustion chamber 240 includes first and second ports 244,245. The first port 244 is in communication with a first gas flow path P1, which may be defined by a manifold or the like, which leads to the passage 213*a* leading into the cylinder 210. The second port 245 is in communication with a second gas flow path P2, which again may be defined by a manifold or the like, which leads to the passage 213*b* leading into the cylinder 210.

Means are provided for selectively controlling the flow of material into and out of the chamber 240, including to and from the intake I and exhaust E, and through the ports 244,245. In one embodiment, this means comprises a number of valves 246,247,248,249. As illustrated, in one embodiment, first and second valves 246,247 are located in the combustion chamber 240 from the intake I, on either side of the first port 244. The other two valves 248,249 are located on either side of the second port 245 towards the exhaust E. Operation of these valves will be described in more detail below. Valve 246 is referred to herein as the air entrance or admission valve. Valve 249 is referred to as the exhaust control valve. The valves 247,248 are referred to as the combustion chamber control valves. In some engine configurations, valves 246,247 may be configured as self-operated or self-actuated check valves.

Figure 38:
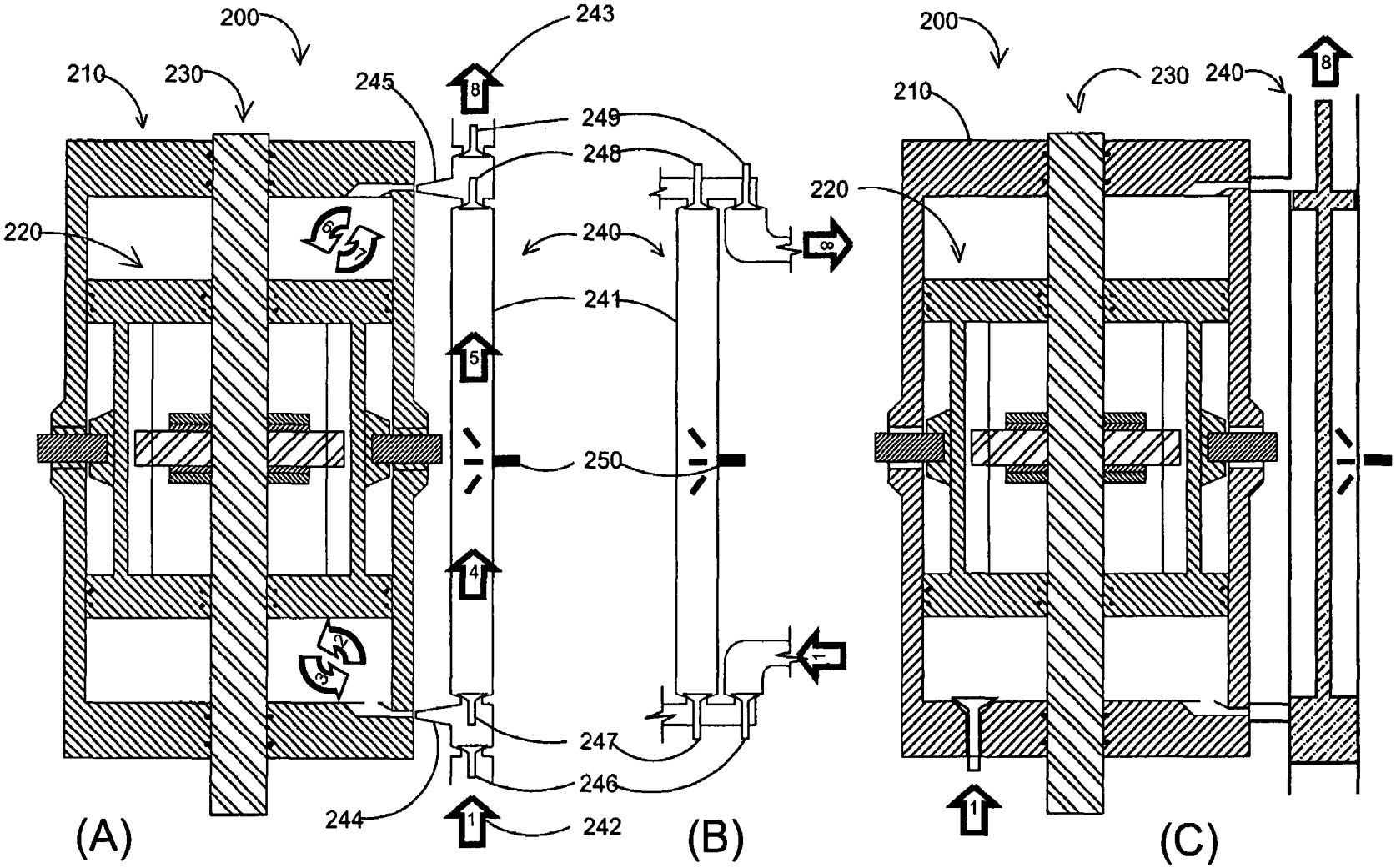
FIGS. 38A–C illustrate embodiment of valve configurations for the engine illustrated in FIG. 32.

FIG. 32 illustrates but one configuration of valves for controlling the flow of gasses through the engine 200. FIG. 38(*b*) illustrates another example, where the pairs of valves 246,247 and 248,249 are configured in a more conventional manner rather than in a symbolical way with appropriate connecting passages. FIG. 38(*c*) illustrates yet another configuration of means for flow control, that means comprising a single valve having a pair of heads. Movement of the valve causes the location of the heads to vary, thus selectively permitting gasses to flow to and from the variable volume chambers, the combustion chamber, and the intake and exhaust.

In this embodiment, the configuration of the engine is similar to that described above (FIG. 38*a*) when considering the configuration of passages and flow paths. Of course, other means may be provided for controlling the flow of gasses, including other types of valves, including check, poppet, butterfly and others. The valves may be mechanically or electro-mechanically operated.

Means are provided for delivering fuel to the combustion chamber 240 for combustion. In one embodiment, this means comprises one or more fuel injectors 250 which are configured to inject fuel into the combustion chamber 240. In one embodiment, the one or more injectors 250 are configured to inject fuel into the portion of the chamber 240 between the sets of valves.

Means are also provided for igniting fuel within the combustion chamber 240. In one embodiment, this means comprises one or more spark plugs or other combustion initiating device (such as depending upon the type of fuel used, a glow plug might be used).

Operation of the engine 200 will now be described in conjunction with FIGS. 38 and 39. First, a general description of the flow of gasses through the engine 200 will be described with reference to FIGS. 38(*a*) and (*b*). Air is delivered to the intake I of the combustion chamber 240. The air may be delivered from a variety of sources, such as through an air cleaner from an ambient source, or may be turbo or super-charged.

Air is delivered from the intake I as shown at (1), and is delivered through valve 246 to the first port 244, and thereon enters a first variable volume chamber (which in the example illustrated, is the admission/compression chamber located below the piston 220), as shown at (2). Later, the piston compresses that gas, as shown at (3). The compressed, admitted gas is expelled back to port 244 and permitted to flow through valve 247 into the combustion chamber 240, as shown at (4). For a moment the gas is heated in the chamber 240 while the piston 220 travels to the other end of the cylinder. After combustion is initiated, as shown at (5), combustion gasses flow through valve 248 and through port 245 into the second variable volume chamber, as shown at (6). As shown at (7), those gasses are later expelled back through the port 245 and then, as shown at (8), pass through valve 249 and are expelled through the exhaust E.

The detailed operation of the engine will now be described with reference to FIGS. 39(*a*)–(*e*). FIG. 39(*a*) illustrates the piston 220 near the top of its stroke moving towards the second cover of the cylinder 212*b* at the first end of the cylinder 210. At this time, air is being admitted into the admission/compression chamber from the intake I via the valve 246. At the same time, combustion gasses are being exhausted out of the power/exhaust chamber through the valve 249 to the exhaust E. The combustion chamber 240 is full of compressed air from a previous cycle and, near this time, the fuel injector is prepared to inject fuel into the chamber to start combustion. At this time, valves 247 and 248 are closed, sealing the combustion chamber for combustion. Thereafter, combustion is initiated.

Figure 39:
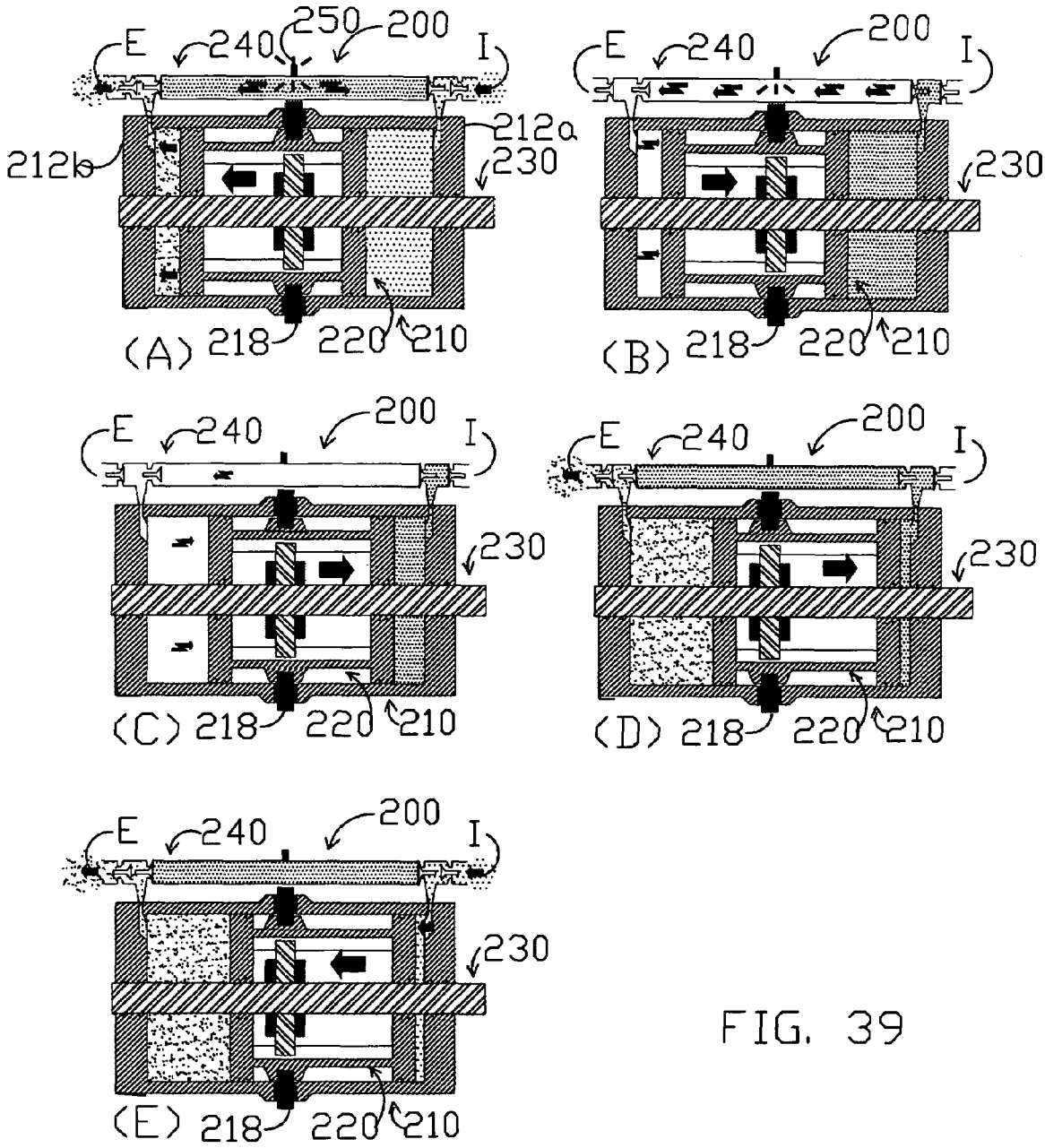
FIGS. 39A–E are simplified cross-sectional views of the engine illustrated in FIG. 32 demonstration the operating cycle of the engine.

Referring to FIG. 39(*b*), the admission and exhaust valves 246 and 249 have closed. The piston 220 is starting to return towards first cover 212*a*. Combustion gasses are expanding and pass into the power/exhaust chamber from the combustion chamber 240 pushing the piston 220 into its power stroke. At the same time, the piston 220 is compressing air in the admission/compression chamber, the valves 246,247 are closed preventing flow of air from the chamber back to the intake I or to the combustion chamber.

As illustrated in FIG. 35(*c*), expanding combustion gasses continue to force the piston towards the bottom of its stroke towards the second end of the cylinder 210, also causing additional compression of air in the admission/compression chamber.

Thereafter, as illustrated in FIG. 39(*d*), the entrance valve 247 opens to let the compressed air into the combustion chamber. Also, the exhaust valve 249 opens to let the dissipated expansion gasses travel to the exhaust E. Meanwhile, the compressed gasses in the combustion chamber 240 are being further expanded by the heat of previous combustions.

As illustrated in FIG. 39(*e*), the piston begins moving back towards the first end of the cylinder 210. At that time, the entrance valve 247 closes and the admission valve 246 opens, permitting air to flow from the intake I into the admission/compression chamber. Combustion gasses are pressed from the power/exhaust chamber through the exhaust valve 249 (and prevented from entering the combustion chamber by exit valve 248). The cycle then repeats itself.

As described above, as the piston travels back and forth within the cylinder linearly, the piston is forced to rotate because of the engagement of the cam leaders 218 with the curved cam(s) 222 on the piston. As the piston rotates, the piston effectuates rotation of the associated main shaft 230. In this manner, combustion gasses cause the piston to move, thus rotationally driving the main shaft 230. The main shaft 230 may be used to power various elements, such as rotate the wheels of a vehicle or the like.

Various aspects of this embodiment engine 200 will now be appreciated. Conventional engines define only a single chamber between a top of each reciprocating piston and the cylinder in which the piston is mounted. This single chamber is utilized to intake gasses for combustion, contain combustion, and expel exhaust gasses. In accordance with the engine as described, the engine defines three chambers for these functions: an admission/compression chamber under the piston, the interconnecting combustion chamber and the expansion/exhaust chamber over the piston.

Figure 40:
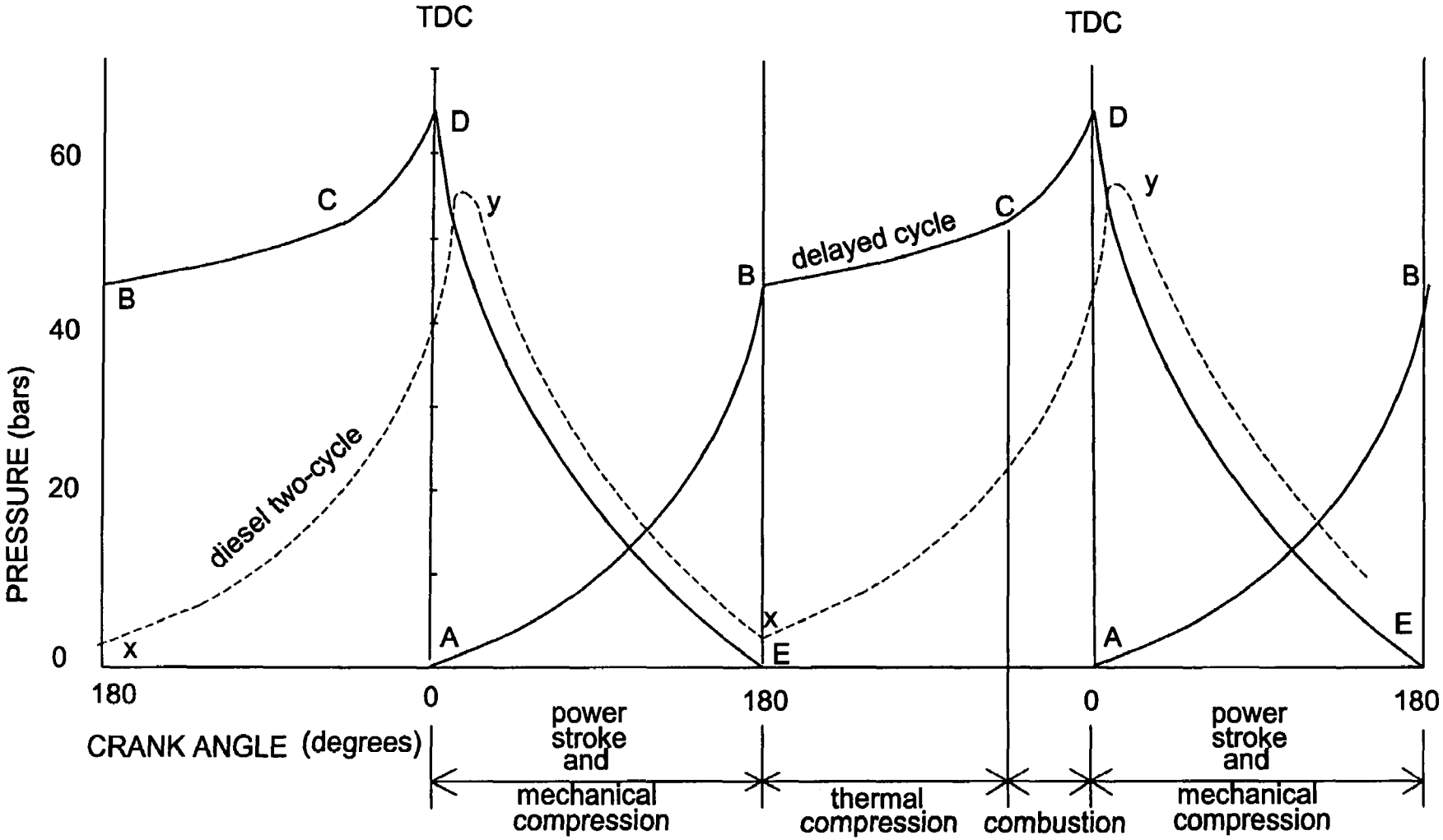
FIG. 40 is a chart illustrating the cycle the delayed cycle of the engine.

FIG. 40 is a graph illustrating the operating cycle of the engine just described. In this graph, a typical diesel cycle is illustrated in dotted line to serve a basis for comparison to the present engine cycle.

Segment AB represents the portion of the engine cycle in which the air in the admission/compression chamber is compressed. As illustrated, this portion of the cycle is similar or almost identical to the compression curve of the diesel cycle. Segment BC represents the thermal expansion of the compressed air as it is heated by the surrounding walls inside the combustion chamber before the fuel is ignited. Segment CD represents the combustion gas expansion inside the closed combustion chamber. Segment DE represents the powers stroke that occurs when the gases from the combustion chamber are released into the expansion/exhaust chamber.

As will be appreciated from the description of the operation of the engine and as illustrated in the cycle diagram, some portions of the engine cycle overlap one another. In particular, the compression (AB) and expansion (DE) portions of the cycle overlap, as the compression and expansion portions of the cycle occur at the same time on either side of the piston. Other portions of the cycle, including those associated with the admission and exhaust functions, are not illustrated on the graph because they have no relevant significance.

Another embodiment of the invention is yet another lubrication system. In one embodiment, the lubrication system has particular applicability to the engine illustrated in FIG. 32.

Figure 41:
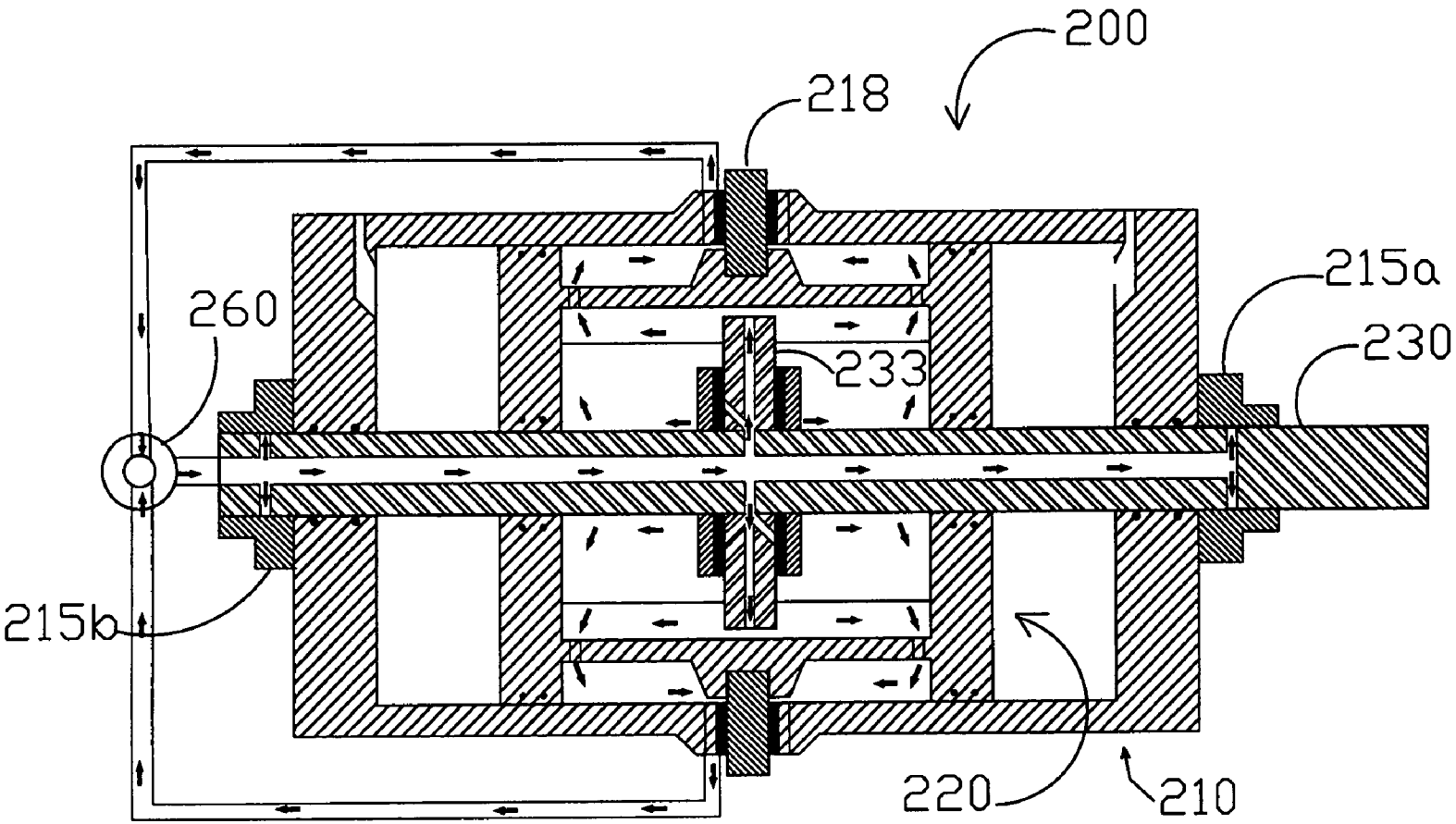
FIG. 41 is a cross-sectional view of a portion of the engine illustrated in FIG. 32 illustrating a lubricating system in accordance with another embodiment of the invention.

Referring to FIG. 41, in one embodiment, oil or other lubricating fluid/material is provided by a pump 260 from a source, such as an oil reservoir. Preferably, the pump 260 provides the oil under pressure.

The oil is preferably delivered through one or more passages provided in the main shaft 230. As illustrated, in one embodiment, a single passage extends though the main shaft 230. Oil is provided to one end of the passage and routed therethrough. As illustrated, in a preferred embodiment, one or more sub-passages lead from the main passage for providing oil to various components, such as the bearing and seals which support and seal the main shaft, as well as to the piston. As illustrated, oil is provided to the interior of the piston for lubricating the cam followers 234 and the cam leaders 218, as well as the rings of the piston.

Oil may be returned to the pump 260 or to a sump through a return passage or passages. In one embodiment, oil is returned through passages which align with the interior portion of the piston while the piston reciprocates.

The oil provides both lubrication and cooling. In particular, oil flowing through the main shaft and into the piston aids in cooling the piston and main shaft. Of course, the lubricating system may include an oil cooler or the like for reducing the temperature of the oil in the system.

Figure 42:
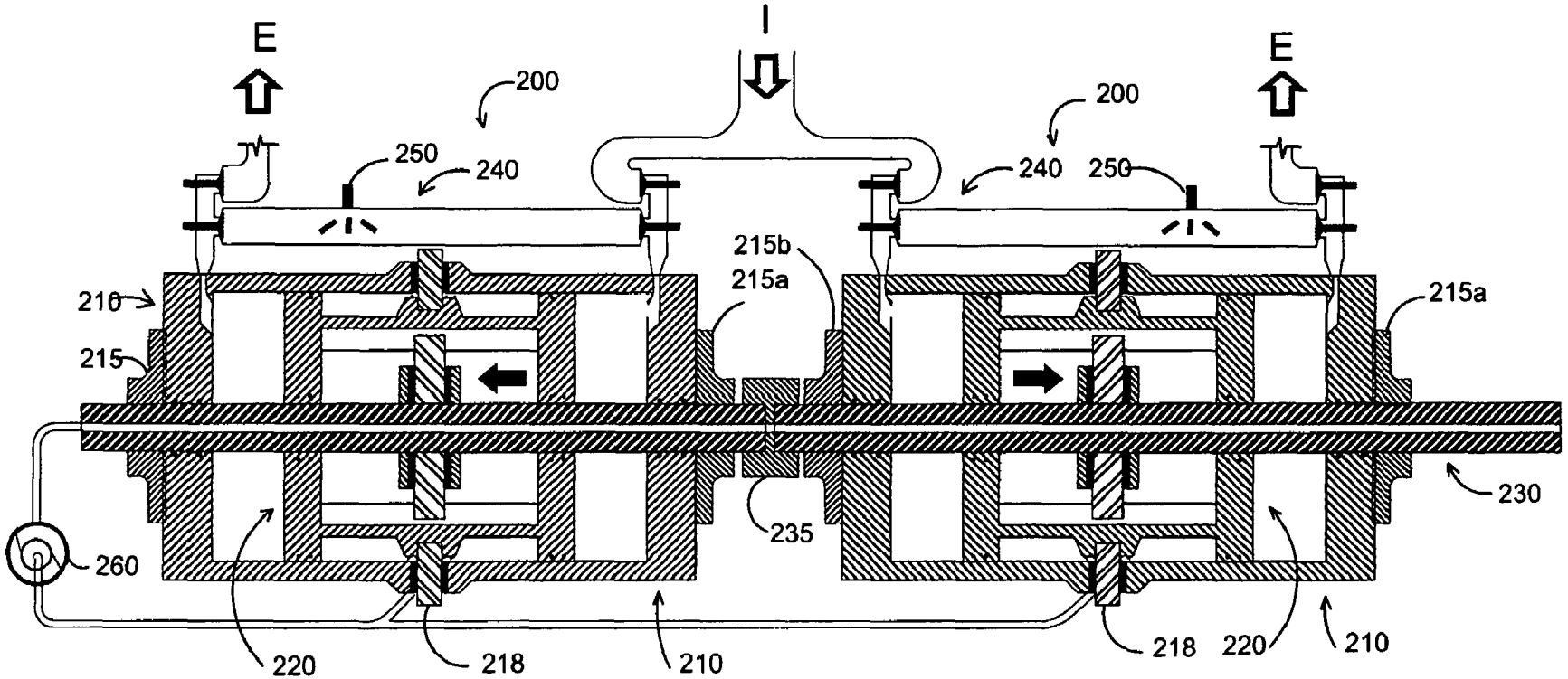
FIG. 42 illustrates another embodiment of an engine in accordance with the invention, the engine comprising two engines illustrated in FIG. 32 coupled to one another.

Of course, other embodiments of the engine are contemplated. FIG. 42 illustrates an embodiment of an engine of the invention which essentially comprises two of the engines 200 illustrated in FIG. 32 having their main shafts connected to one another. As illustrated, a shaft coupling 235 couples the two shafts 230 to one another. In this form, a single "two-cylinder" engine is created. An advantage of this engine configuration is that the pistons can be configured to move in opposite directions, such that engine vibrations cancel one another.

In such an arrangement, air may be provided to both of the "cylinders" of the engine via a common air intake. Likewise, exhaust may be routed from each cylinder to a single exhaust outlet. Similarly, a single lubricating oil sump and pump may be provided. A commonly controlled fuel injection system and ignition system may also be provided.

In one embodiment, the combustion chamber 240 may be defined or formed within a body housing or other member which is separate from the body which defines the cylinder. In another embodiment, those bodies may be coupled to one another. In yet another embodiment, a single body may define both the combustion chamber and cylinder. One advantage to such an embodiment may be the transfer of heat between the chambers, such as for added thermal expansion of gasses in the combustion chamber. It is also noted that the functions of the first and second variable volume chambers is reversed, with intake and compression occurring above the piston and expansion and exhaust occurring below the piston.

Another embodiment engine 300 in accordance with the invention is illustrated in FIGS. 43–50. It will be appreciated that various features of this embodiment engine 300 have applicability to those embodiments described above, as well as engines of other types.

Figure 43:
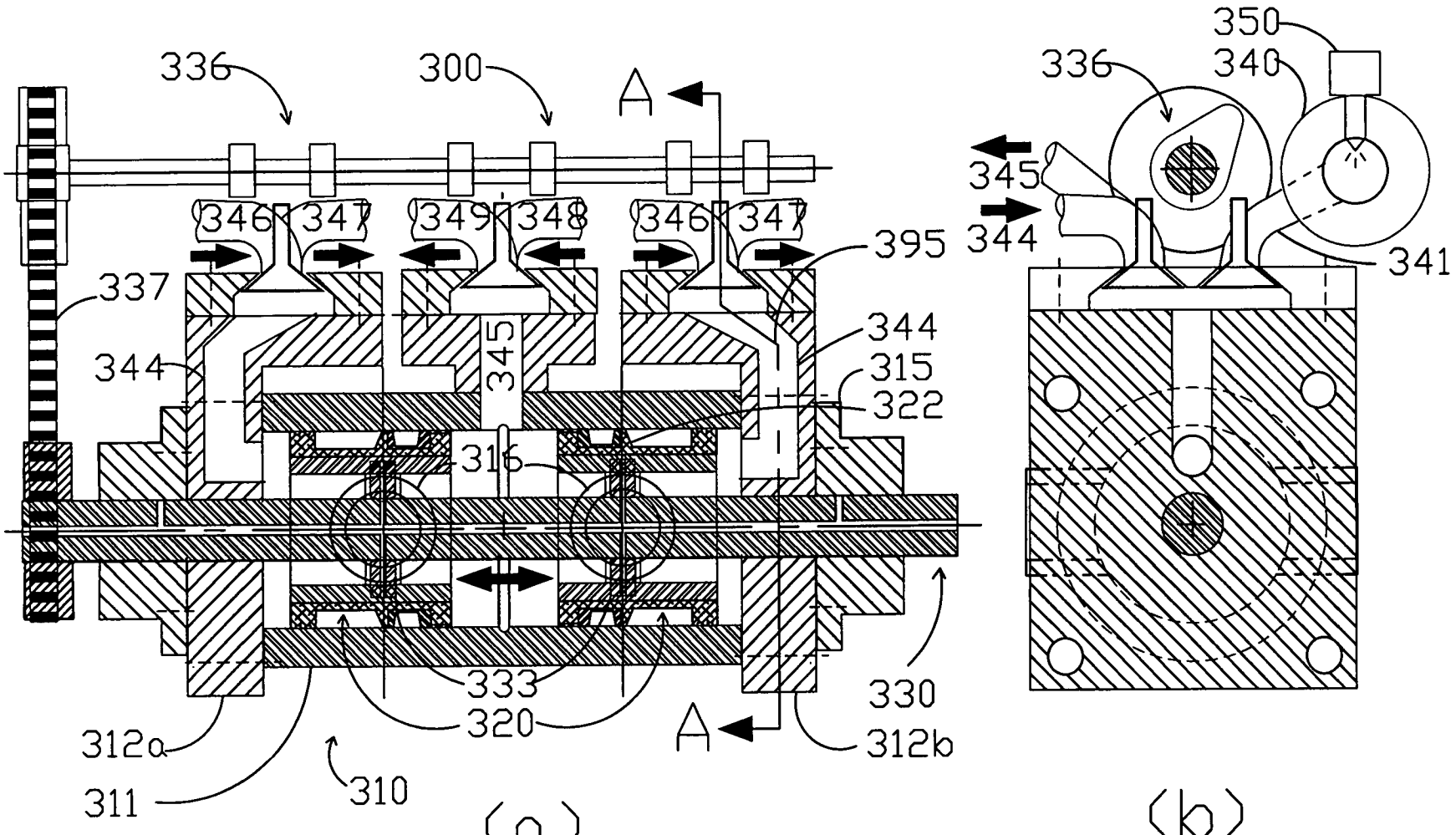
FIG. 43A is a cross-sectional side view of another embodiment of a multiple piston engine in accordance with the present invention.
FIG. 43B is a cross-sectional view of the engine illustrated in FIG. 43A taken along line A—A therein.

FIG. 43(*a*) is a cross-sectional view of another multiple piston engine in accordance with the present invention. In this embodiment, two pistons 320 are configured to move within a single cylinder 310 defined by a cylinder wall 311. As illustrated, both pistons 320 are mounted to a common main shaft 330. For reasons which will become apparent, the pistons 320 are spaced from one another along the shaft.

The pistons 320 are preferably mounted to the shaft 330 and the cylinder 310 in a manner similar to that described above. In particular, each piston 320 has a curved cam 322. One or more cam leaders (not shown) is preferably supported by the cylinder wall 311 and engages the curved cam 322. Likewise, one or more cam followers 333 associated with the main shaft 330 are configured to engage one or more straight cams at the inside of the piston 320. In this manner, the pistons 320 are permitted to rotate and translate within the cylinder 310, and at the same time rotatably drive the main shaft 330. Preferably, the pistons 320 are mounted in reverse to one another, so that during operation of the engine, the pistons 320 are configured to rotate the main shaft 330 in the same direction.

Once again, various passages or ports lead to and from the cylinder 310. In one embodiment, an intake port 344 leads from an intake source to each end of the cylinder 310. As illustrated, one intake port 344 is preferably defined through a first cylinder cap or cover 312*a*, and the other intake port defined through the opposing second cylinder cap or cover 312*b*.

In the embodiment illustrated, the intake passages 344 lead to the ends of the cylinder. In other embodiments, the passages 344 could lead through the cylinder wall 311 in the area of the ends of the cylinder.

Preferably, the flow of air through the intake passages 344 is controlled by one or more valves 346 or other elements or members.

An exhaust port or passage 345 preferably leads from a central part of the cylinder 310 through the cylinder wall 311. Preferably, the passage 345 leads to an area of the cylinder 310 which is between the pistons 320. An exhaust valve 349 or other element or member preferably controls the flow of material through the exhaust passage 349.

As described in more detail below with respect to FIGS. 46(*a*)–(*c*), return passages (one of which is illustrated in FIG. 43(*b*) as element 341) preferably lead from each end of the cylinder 310 to a combustion chamber (see FIG. 43(*b*)) for delivering compressed intake air. The flow of compressed intake gas through those passages is preferably controlled by appropriate valves 347. Likewise, at least one combustion gas delivery passage (not shown) extends from the combustion chamber to the area of the cylinder between the pistons. The flow of combustion gasses through this passage is preferably controlled by a valve 348.

It will be appreciated that, as with the other engines described herein, the intake, exhaust and other passages may lead to one or more openings in the cylinder, and that there may be other numbers of such passages. The number, size and other characteristics of the ports or passages primarily depends upon the desired flow rate and other operational characteristics of the engine.

Though not shown, the intake passages 346 preferably extend between the cylinder an intake air source. This source may be an intake plenum, a passage leading to a turbocharger or supercharger or the like.

As indicated, compressed intake air is preferably delivered from the cylinder to a combustion chamber and combustion gasses are delivered from the combustion chamber to the cylinder. FIG. 43(*b*) illustrated one embodiment of the engine 300 including a combustion chamber 340. FIG. 43(*b*) illustrates one embodiment where the combustion chamber 340 is defined by a body which is separate from the cylinder 310. Of course, the combustion chamber may be formed in a portion of a body forming the cylinder.

Means are provided for moving the valves 346,347,348, 349. In a preferred embodiment, each valve includes a valve stem. The stem is mounted for engagement by a camshaft 336. As illustrated in FIG. 43(*b*) and in FIG. 46(*a*), in one embodiment the valves 347,348 are offset from the valves 346,349 on either side of a vertical plane containing the camshaft 336.

The camshaft 336 is configured, as is known in the art of engines, to selectively engage the valves 346,347,348,349 to open and close them. In one embodiment, the valves 346, 347,348,349 are biased, such as with springs, upwardly into a closed position. In this arrangement, the camshaft 336 is configured to press the valves downwardly into an open position. Of course, the camshaft 336 is carefully configured to control the timing of the opening and closing of the valves.

As illustrated, the main shaft 330 is mounted for rotation, such as supported by one or more bearings 315. The camshaft 336 may be driven by the main shaft 330, such as by the chain or belt drive as illustrated, by direct gear engagement or the like. The camshaft 336 may also be driven independently or indirectly in other manners.

Operation of the engine 300 is similar to the embodiment engine 200 described above. Intake air passes through the intake passages 344 into the cylinder 310 as permitted by the opening of valves 346. As the pistons 320 move towards the ends of the cylinder (which occurs simultaneously), which maybe referred to as a "bottom dead center" position, that air is compressed. The compressed air is allowed to flow to the combustion chamber 340 through return passages 341 (only one of which is illustrated in FIG. 43(*b*)) as permitted by the opening of the valves 347 (at which time valves 346 are closed).

Fuel is preferably added to the air in the combustion chamber 340, such as by an injector 350, and combustion of the fuel is initiated (such as by a spark plug or other ignition element). The expanding air/fuel charge is permitted to flow from the combustion chamber 340 through the expansion or combustion gas (not shown) to the area between the pistons 320 as permitted by the opening of valve 348. At this time, the pistons 320 are preferably close to one another (at a "top dead center" position). The expanding gasses cause the pistons 320 to move back towards the ends of the cylinder. Of course, as the pistons 320 move towards the ends of the cylinder, the next charge of compressed air is delivered from the area at the ends of the cylinder to the combustion chamber. Further, as the pistons move back towards the center of the cylinder 310, exhaust gasses are exhausted from the cylinder 310 through the passage 345 to an exhaust passage (not shown).

As the pistons 320 move back and forth in the cylinder 310, they rotate the main shaft 230 in the manner described relative to the engine 200.

As indicated above, the engine 300 may have various configurations. FIGS. 44–50 illustrate embodiments of certain of the components of the engine 300.

Figure 44:
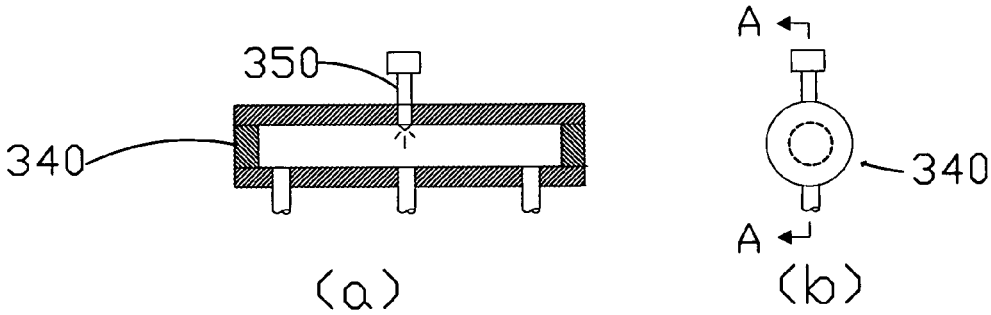
FIG. 44A is an end view of a combustion chamber of the engine illustrated in FIG. 43B.
FIG. 44B is a cross-sectional view of the combustion chamber illustrated in FIG. 44A taken along line A—A therein.

FIGS. 44(*a*) and (*b*) illustrated one embodiment of the combustion chamber 340 of the engine. As illustrated, the combustion chamber 340 preferably comprises a body defining a hollow interior space for containing gas and, as delivered by one or more fuel delivery elements such as injectors 350, fuel. As illustrated, various passages lead to and from the combustion chamber, such as to the cylinder as described above.

Figure 45:
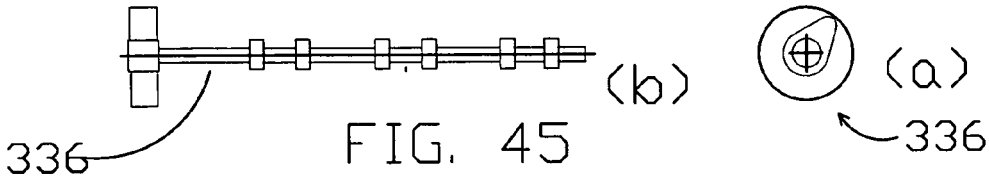
FIG. 45A is an end view of a camshaft of the engine illustrated in FIGS. 43A and 43B.
FIG. 45B is a side view of the camshaft illustrated in FIG. 45B.

FIGS. 45(*a*) and (*b*) illustrate a camshaft 336 of the engine. As illustrated, the camshaft 336 preferably has a gear or pulley located at or near one end for driving by a chain or belt, such as described earlier. The camshaft 336 has one or more nodes or cam surface which engage the valves.

Figure 46:
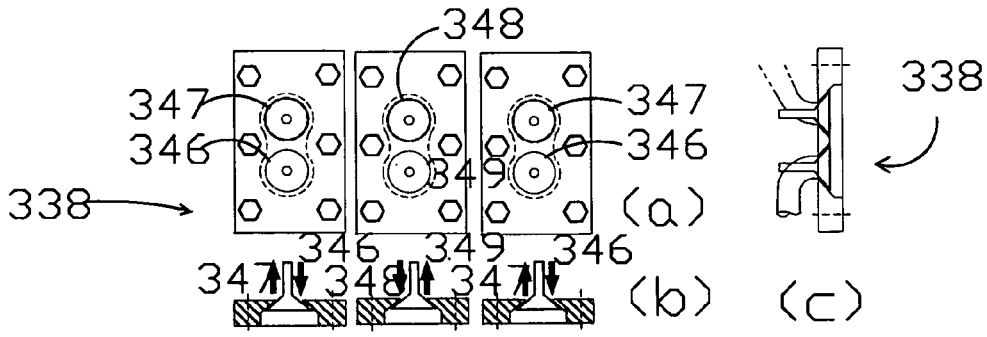
FIG. 46A is a top view of a engine head and valve arrangement for the engine illustrated in FIG. 43A.
FIG. 46B is a side top view of the engine head and valve arrangement illustrated in FIG. 46A.
FIG. 46C is a side top view of the engine head and valve arrangement illustrated in FIG. 46A.

FIGS. 46(*a*)–(*c*) illustrate in greater detail a valve arrangement of the invention. In one embodiment, the valves 346,347,348,349 are associated with an engine head 338. The engine head 338 defines portions of the passage described above and valve seats for the valves. As illustrated, the engine head 338 may comprise more than one component or member. The head 338 might also comprise a single body.

Figure 47:
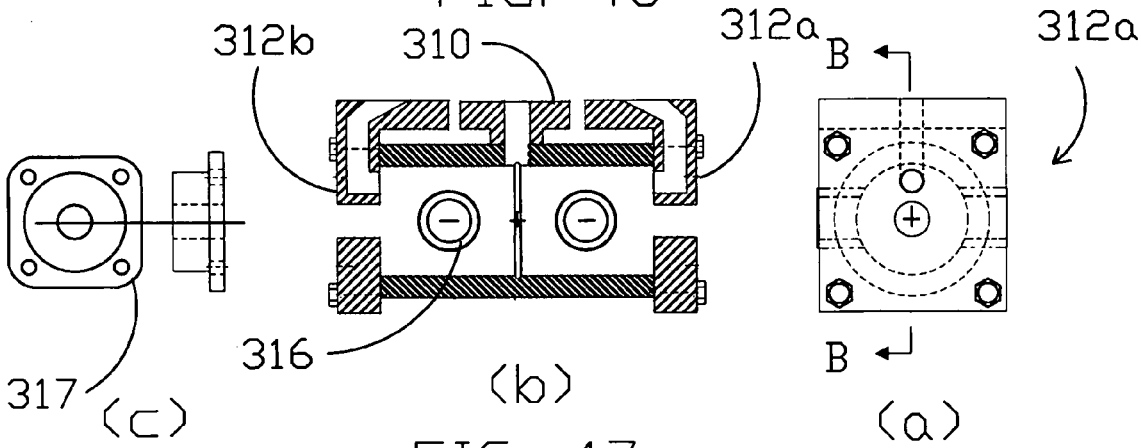
FIG. 47A is an end view of a cylinder portion of the engine illustrated in FIG. 43A.
FIG. 47B is a cross-sectional view of the cylinder portion of the engine illustrated in FIG. 47A taken along line B—B therein.
FIG. 47C is a front and side view of a shaft support for connection to the cylinder portion of the engine.

FIGS. 47(*a*)–(*c*) illustrates in more detail the cylinder 310 and associated structures of the engine. As illustrated, passages 316 are provided in the cylinder wall through which cam leaders (not shown) extend for engagement with each piston. FIG. 47(*c*) illustrates one bearing support 317 for the main shaft.

FIG. 47(*b*) illustrates the cylinder end covers 312*a,b*. In one embodiment, the covers 312*a,b* are bolted to the cylinder. In one embodiment, the cylinder end covers 312*a,b* may actually be formed as a single element or member which defines the various passages described and illustrated, and which accepts the cylinder wall 311 therein. In forming the engine, the engine head(s) (illustrated in FIGS. 46(*a*)–(*c*)) may then be connected to the cover member.

Figure 48:
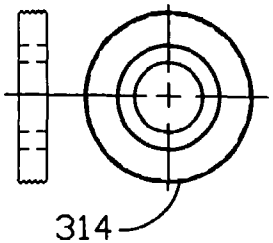
FIG. 48 is a front and side view of a piston cap in accordance with an embodiment of the invention.

In one embodiment, each piston 320 is again generally hollow. End caps 314, as illustrated in FIG. 48, preferably close each end of each piston 320. As illustrated, the end caps 314 preferably seal to the piston and around the main shaft, thus preventing the flow of material through the piston. Of course, the pistons 320 could be formed in other manners. For example, the top end of each piston might be formed with a generally closed head (except for the opening for the main shaft).

Figure 49:
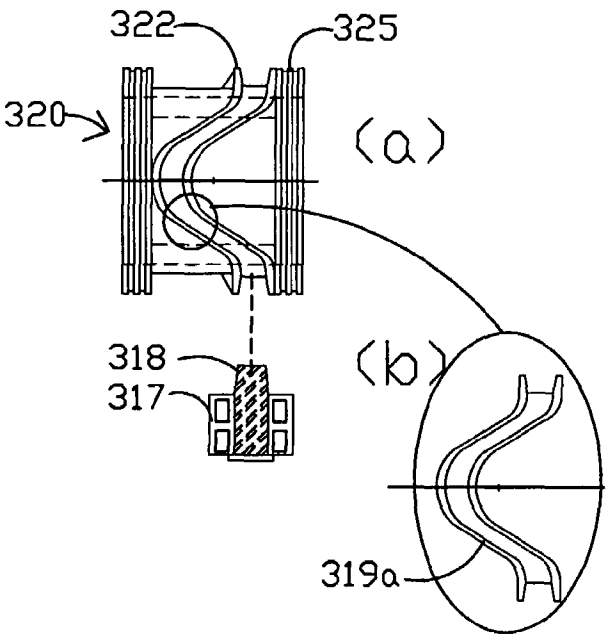
FIG. 49A is a side view of a piston and mating cam follower of the engine illustrated in FIG. 43A.
FIG. 49B is an enlarged view of a cam insert of the piston illustrated in FIG. 49A.

FIGS. 49(*a*) and (*b*) illustrate an embodiment of the piston 320 including a curved cam 222 formed therein. In one embodiment, the curved cam 222 is defined by an insert 319*a*. The insert is preferably of a highly durable material, such as steel. As illustrated, a cam leader 318 as mounted to a bearing 317 (which is preferably supported by the cylinder wall 311, as illustrated in FIG. 47).

Figure 50:
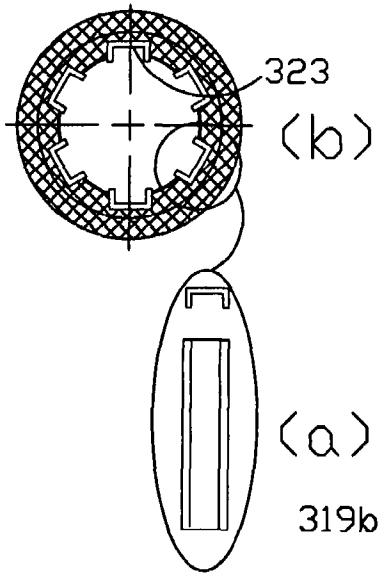
FIG. 50A is a cross-sectional top view of a piston of the engine illustrated in FIG. 43A.
FIG. 50B is an enlarged top and front view of a cam insert of the piston illustrated in FIG. 50A.
Figure 51:
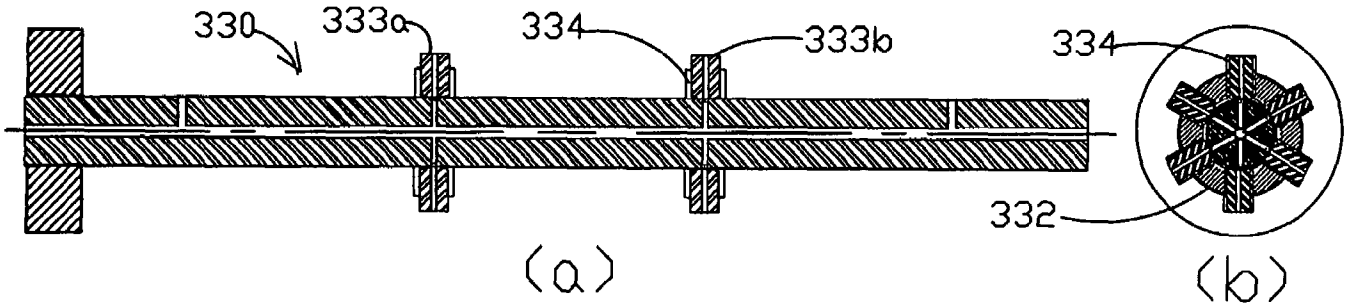
FIG. 51A is a cross-sectional side view of a main shaft of the engine illustrated in FIG. 43A.
FIG. 51B is a cross-sectional view of the main shaft illustrated in FIG. 51A taken along line C—C therein.

Similarly, as illustrated in FIGS. 50(*a*) and (*b*), the straight cams 323 are preferably defined by one or more inserts 319*b*. The straight cams 323 are configured to engage mating cam followers 333 located on the ring 332 of the main shaft 330, as illustrated in FIGS. 51(*a*) and (*b*). As illustrated, a first set of cam followers 333(*a*) are provided for one piston, and a second set of cam followers 333(*b*) are provided for the other piston. The cam followers 333(*a*) and (*b*) are spaced apart corresponding to the locations of the pistons.

This embodiment engine 300 has several advantages. One particular advantage is that the pistons move in opposing relationship, thus substantially damping or canceling the vibrations caused by one another. This allows the engine to run much more smoothly. In addition, the use of the two pistons permits compression of larger amounts of intake air, and for more effective combustion and a higher engine efficiency. The engine 300 reduces the number of components necessary as compared to the "joined" engine illustrated in FIG. 42. For example, the engine 300 only requires one combustion chamber, one camshaft, and one main shaft, even though two pistons are utilized. This permits the engine to have a simple configuration with minimal parts, while at the same time permitting the engine to have a high power output.

Figure 52:
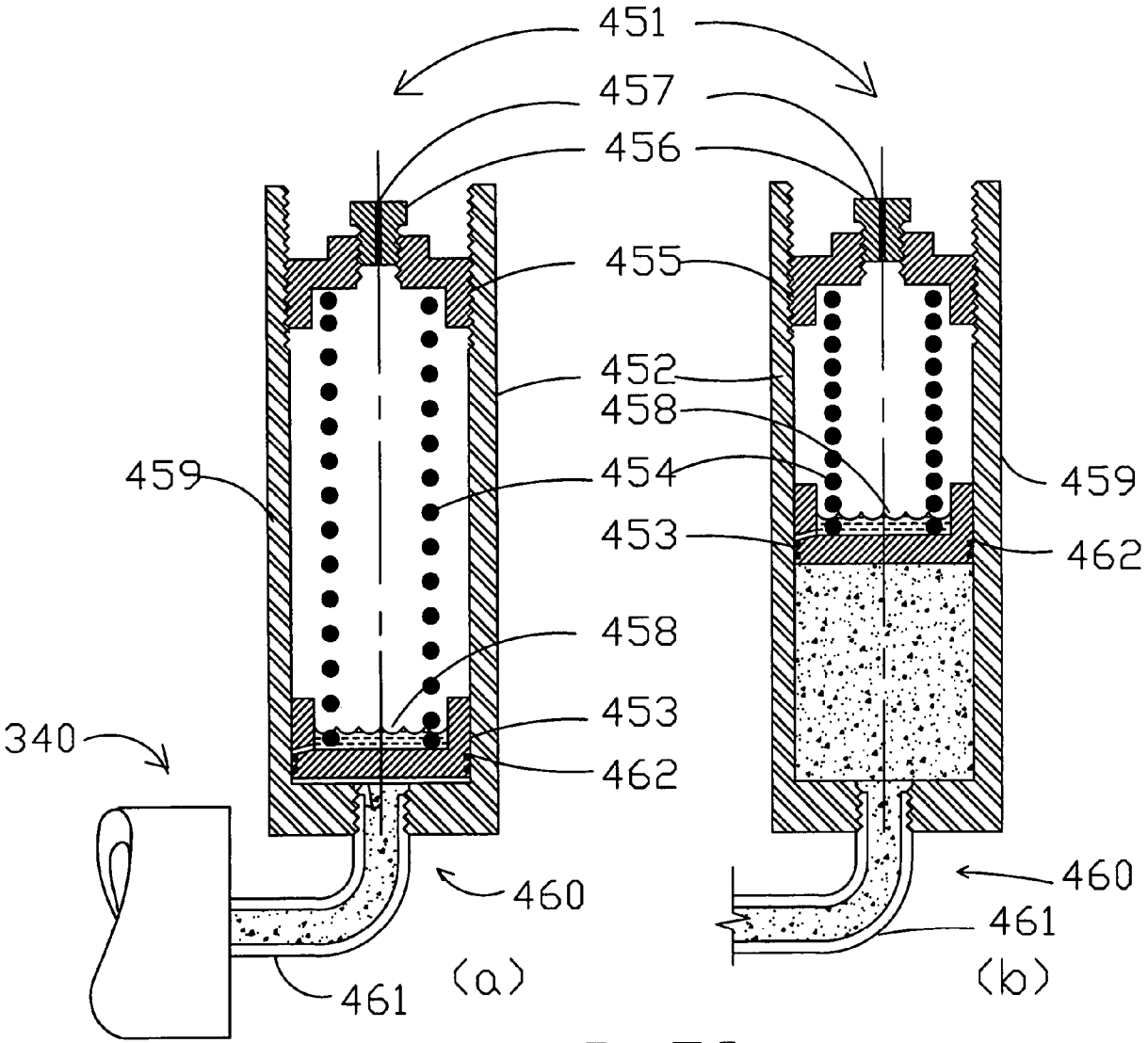
FIG. 52A is a cross-sectional view of an accumulator in accordance with an embodiment of the invention, a piston of the accumulator shown in a first position.
FIG. 52B illustrates the accumulator of FIG. 52A with the piston in a second position.

FIGS. 52(*a*) and (*b*) illustrates a combustion gas accumulator 451 in accordance with an embodiment of the invention. In general, the accumulator 451 comprises a body 459 which defines a generally enclosed interior space. As illustrated, the body 459 is generally cylindrical in shape. The body 459 may have a wide variety of shapes and sizes, however.

In the embodiment illustrated, the body 459 of the accumulator 451 has an open end which is closed by a compression cap 455. As illustrated, the compression cap 455 threadingly engages the body 459. The compression cap 455 is preferably removable from the body 459 to permit the below-described components to be located in the interior space of the body. The compression cap 455 could be permanently connected to the body 459 once those components are located in the body 459, or could be attached in other ways than illustrated, such as by external threads on the body, by compression fit, by welding or the like.

In one embodiment, a plug 456 is connected to the compression cap 455. The plug 456 preferably defines an air passage 457 therethrough. The plug 456 may be connected to the compression cap 455 with threads, as illustrated, or in other manners. In one embodiment, the compression cap 455 may simply define an air or bleed passage without having a separate plug 456.

An opening 460 is located in the body 459 at its end opposite the compression cap 455. In one embodiment, a passage 461 leads from a combustion chamber, such as the combustion chamber 340 of the engine just described and illustrated in FIG. 43*a*, to the opening 460. As illustrated, the passage 461 may be defined by a conduit, tubing or the like. Preferably, the passage 461 is defined by tubing capable of withstanding high pressures and temperatures.

A piston 453 is located in the interior space of the body 459 between a first end where the opening 460 is located and a second end where the compression cap 455 is located. The piston 453 is preferably movably mounted in the body 459. The piston 453 divides the interior space of accumulator 451 into a first compartment or chamber and a second compartment or chamber, the two compartments or chambers located on either side of the piston from one another. A first of the compartments or chambers is preferably in communication with the opening 460.

In a preferred embodiment, the piston 453 is biased towards the opening 460 and a position where the size of the first chamber is minimized, as illustrated in FIG. 52(*a*). In one embodiment, the accumulator 451 includes means for biasing the piston 459. As illustrated, the means comprises a spring 454. The means may comprise other elements such as an air bladder or other compressible member.

As illustrated, one or more rings or other sealing members 462 may be associated with the piston 453 for effectively sealing the piston/body interface, thus reducing or preventing the flow of material between the first and second compartments or chambers. Lubricant 458 maybe located in the second compartment or chamber to lubricate the seals 462 and the spring 454.

The accumulator 451 is effective for use with a combustion chamber in "absorbing" some of the combustion gasses, and may be used with the engines described herein. In particular, when a piston of the engines described herein is moving towards its "top dead center" position, combustion may already be initiated in the combustion chamber. If the combustion gasses are routed to the cylinder while the piston is still in that mode, engine efficiency may be lowered and damage to the engine, and particularly the piston, may occur. The accumulator 451 is effective in absorbing some of the expanding combustion gasses from the combustion chamber at this time. When the piston reaches top dead center and begins to move downwardly (or sideways, depending on the orientation of the piston), those gasses may expand from the accumulator to the cylinder.

In operation, as illustrated in FIG. 52(*a*), the piston 453 is preferably biased to a position where the first compartment or chamber is generally minimized. When combustion occurs excessive high pressure combustion gasses (which may include burned and unburned fuel, air and other exhaust products) forces the piston 453 upwardly, whereby those gasses and other materials are housed within the accumulator 451, as illustrated in FIG. 52(*b*). The piston forces these gasses and other materials out of the accumulator 451 when the pressure of those gasses become sufficiently low, such as when the piston begins to move downwardly from top dead center.

It will be appreciated that the spring 454 is preferably chosen to provide a particular biasing force. In particular, the spring 454 is preferably chosen so that the piston only moves upwardly in response to a sufficiently high pressure. The biasing force of the spring is further reinforced by the compression of the air in the chamber at the other side of the piston.

Of course, the engines of the invention may be utilized in a variety of applications/environments and the engine may include additional features and elements, such as emission control elements (such as catalytic converters along the exhaust path), air intake filters and other elements.

Various additional aspects of the invention will now be appreciated. One aspect of the invention is an engine where combustion is initiated in a chamber which is separate from the chamber in which the piston is located. In a preferred configuration, the combustion gasses are routed from the combustion chamber to the cylinder or chamber in which the piston is located.

As described above, one aspect of the invention is an output shaft drive configuration. In one embodiment, a piston or pistons are mounted so that rotation (rather than translation) of the piston effect rotation of an output shaft. In one embodiment, the piston(s) are mounted on or along the output shaft or shafts. In one configuration, piston(s) are mounted for rotation and translation.

In one embodiment, a combustion chamber is mounted between an intake and exhaust, but the flow of gasses to and from that chamber is not direct, but through chambers which are associated with a piston/cylinder. In one embodiment, a piston is provided with a cam to effect rotational motion of the piston, the cam design selected to effectuate particular engine cycles.

One embodiment of the invention is an engine without a crankshaft and associated connecting rods and other moving parts. This engine design is particularly suited to miniaturization. In addition, the engine design permits the engine to be utilized not only as a prime mover, but as a compressor or pump.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. An internal combustion engine comprising a body defining a cylinder, a piston movably mounted in said cylinder and dividing said cylinder into a first variable volume chamber and a second variable volume chamber, a combustion chamber, said combustion chamber having an inlet in communication with said first variable volume chamber, and an outlet, said outlet in communication with said second variable volume chamber, said engine having an intake, said intake leading to said first variable volume chamber and said engine having an exhaust, said exhaust in communication with said second variable volume chamber, such that air is drawn through said intake to said first variable volume chamber, is compressed, is delivered to said combustion chamber, is expanded and delivered from said combustion chamber to said second variable volume chamber, and is expelled from said second variable volume chamber to said exhaust.

2. The engine in accordance with claim 1 including means for controlling the flow of air from said intake to said first variable volume chamber and from said first variable volume chamber to said combustion chamber.

3. The engine in accordance with claim 2 wherein said means for controlling comprises at least one valve.

4. The engine in accordance with claim 1 including at least one fuel delivery device configured to deliver fuel into said combustion chamber.

5. The engine in accordance with claim 1 including at least one combustion initiating device associated with said combustion chamber configured to initiate combustion of fuel in said combustion chamber.

6. The engine in accordance with claim 1 wherein said piston is mounted on an output shaft, said piston configured to translate and rotate within said cylinder, said piston when rotating effecting rotation of said output shaft.

7. The engine in accordance with claim 1 wherein said cylinder is defined by a first body and said combustion chamber is defined by a second body.

8. An output shaft drive configuration for an engine comprising:

a cylinder having a first end and a second end and defining an interior space;

an output shaft extending through said cylinder from said first end to said second end;

at least one piston mounted in said interior space of said cylinder, said at least one piston mounted on said output shaft, said at least one piston dividing said interior space into a first variable volume chamber and a second variable volume chamber, said first variable volume chamber in communication with an air intake and a combustion chamber external to said interior space and said second variable volume chamber in communication with said combustion chamber and an exhaust, whereby air is compressed in said first variable volume chamber for delivery to said combustion chamber and combustion gasses are delivered from said combustion chamber to said second variable volume chamber, said at least one piston configured to rotate said output shaft when said at least one piston translates in said cylinder.

9. The drive configuration in accordance with claim 8 wherein said at least one piston defines at least one slot in an outer surface thereof, and including at least one cam element supported by said cylinder and configured to engage said slot.

10. The drive configuration in accordance with claim 9 wherein said at least one slot is curvilinear and engagement of said at least one cam element with said at least one slot causes said at least one piston to rotate in response to translation of said at least one piston.

11. The drive configuration in accordance with claim 8 wherein said at least one piston defines at least one slot on an inner surface thereof and said output shaft includes at least one connecting member engaging said slot on said inner surface, said at least one slot extending parallel to said output shaft, whereby said at least one piston is permitted to move linearly along said output shaft and whereby said at least one piston is configured to effect rotation of said output shaft by engagement of said at least one connecting member with said at least one slot on aid inner surface.

12. The drive configuration in accordance with claim 8 wherein said at least one piston comprises a hollow body having a generally open first end and a generally open second end and a first end cap and a second end cap, said first and second end caps and said hollow body defining a path through which said output shaft extends.

13. The drive configuration in accordance with claim 8 wherein said cylinder comprises a body having a first open end and a second open end and including a first end cap and a second end cap connected to said cylinder and defining apertures through which said output shaft extends at said first and second ends of said cylinder.

14. The drive configuration in accordance with claim 13 wherein said first and second end caps include at least one bearing configured to rotatably support said output shaft.

* * * * *